US010488769B2

(12) United States Patent
Nakata et al.

(10) Patent No.: US 10,488,769 B2
(45) Date of Patent: Nov. 26, 2019

(54) ELECTROPHOTOGRAPHIC PHOTOSENSITIVE MEMBER, AND ELECTROPHOTOGRAPHIC APPARATUS AND PROCESS CARTRIDGE EACH INCLUDING THE ELECTROPHOTOGRAPHIC PHOTOSENSITIVE MEMBER

(71) Applicant: CANON KABUSHIKI KAISHA, Tokyo (JP)

(72) Inventors: Koichi Nakata, Tokyo (JP); Shinji Takagi, Yokohama (JP); Haruki Mori, Ichikawa (JP); Masaki Nonaka, Toride (JP); Shubun Kujirai, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/101,575

(22) Filed: Aug. 13, 2018

(65) Prior Publication Data

US 2019/0056676 A1 Feb. 21, 2019

(30) Foreign Application Priority Data

Aug. 18, 2017 (JP) ..... 2017-158091

(51) Int. Cl.

| | |
|---|---|
| ***G03G 5/06*** | (2006.01) |
| ***G03G 5/07*** | (2006.01) |
| ***G03G 5/047*** | (2006.01) |
| ***G03G 15/00*** | (2006.01) |

(52) U.S. Cl.

CPC ..... *G03G 5/0614* (2013.01); *G03G 5/047* (2013.01); *G03G 5/071* (2013.01); *G03G 15/00* (2013.01)

(58) Field of Classification Search

CPC ..... G03G 5/0614; G03G 5/071; G03G 5/047

See application file for complete search history.

(56) References Cited

U.S. PATENT DOCUMENTS

| | | | |
|---|---|---|---|
| 7,186,489 | B2 | 3/2007 | Uematsu et al. |
| 7,226,711 | B2 | 6/2007 | Amamiya et al. |
| 7,333,752 | B2 | 2/2008 | Kawahara et al. |
| 7,534,534 | B2 | 5/2009 | Nakata et al. |
| 7,732,113 | B2 | 6/2010 | Nakamura et al. |
| 7,910,274 | B2 | 3/2011 | Tanaka et al. |
| 8,088,541 | B2 | 1/2012 | Tanaka et al. |

(Continued)

FOREIGN PATENT DOCUMENTS

| | | |
|---|---|---|
| JP | 2007-011005 | 1/2007 |
| JP | 2007-011006 | 1/2007 |

(Continued)

OTHER PUBLICATIONS

U.S. Appl. No. 15/969,836, filed May 3, 2018, Haruki Mori.

(Continued)

*Primary Examiner* — Thorl Chea

(74) *Attorney, Agent, or Firm* — Venable LLP

(57) ABSTRACT

Provided is an electrophotographic photosensitive member, wherein a surface layer of the electrophotographic photosensitive member contains a copolymer of a hole-transportable compound having a polymerizable functional group and a compound represented by the following general formula (1).

$$Ar^1\text{-}(\text{-}L^1\text{-}P^1)_m \quad (1)$$

11 Claims, 2 Drawing Sheets

(56) References Cited

U.S. PATENT DOCUMENTS

| | | | | |
|---|---|---|---|---|
| 8,343,699 | B2 | 1/2013 | Nagasaka et al. | |
| 8,415,078 | B2 | 4/2013 | Tanaka et al. | |
| 8,465,889 | B2 | 6/2013 | Sekido et al. | |
| 8,524,430 | B2 | 9/2013 | Takagi et al. | |
| 8,546,050 | B2 | 10/2013 | Maruyama et al. | |
| 8,632,931 | B2 | 1/2014 | Sekido et al. | |
| 8,783,209 | B2 | 7/2014 | Kaku et al. | |
| 8,795,936 | B2 | 8/2014 | Sekido et al. | |
| 9,244,369 | B2 | 1/2016 | Tanaka et al. | |
| 9,316,931 | B2 | 4/2016 | Takagi et al. | |
| 9,389,523 | B2 | 7/2016 | Nakata et al. | |
| 9,594,318 | B2 | 3/2017 | Nakata et al. | |
| 9,740,117 | B2 | 8/2017 | Kosaka et al. | |
| 10,042,272 | B2 | 8/2018 | Mori et al. | |
| 2017/0364025 | A1* | 12/2017 | Nakata | G03C 1/49872 |

FOREIGN PATENT DOCUMENTS

| | | |
|---|---|---|
| JP | 2007-272191 | 10/2007 |
| JP | 2007-272192 | 10/2007 |
| JP | 2007-279678 | 10/2007 |
| JP | 2008-070761 | 3/2008 |
| JP | 2008-197632 | 8/2008 |
| JP | 2016-051030 | 4/2016 |

OTHER PUBLICATIONS

U.S. Appl. No. 15/980,806, filed May 16, 2018, Koichi Nakata.
U.S. Appl. No. 16/002,421, filed Jun. 17, 2018, Koichi Nakata.
U.S. Appl. No. 16/053,905, filed Aug. 3, 2018, Ryoichi Tokimitsu.

* cited by examiner

ELECTROPHOTOGRAPHIC PHOTOSENSITIVE MEMBER, AND ELECTROPHOTOGRAPHIC APPARATUS AND PROCESS CARTRIDGE EACH INCLUDING THE ELECTROPHOTOGRAPHIC PHOTOSENSITIVE MEMBER

BACKGROUND OF THE INVENTION

Field of the Invention

The present invention relates to an electrophotographic photosensitive member, and an electrophotographic apparatus and a process cartridge each including the electrophotographic photosensitive member.

Description of the Related Art

The surface layer of an electrophotographic photosensitive member is required to have wear resistance and chemical stability because a stress caused by a series of electrophotographic processes including charging, exposure, development, transfer, and cleaning is repeatedly applied to the surface layer.

Means for improving the wear resistance is, for example, a method involving incorporating a curable resin into the surface layer of the electrophotographic photosensitive member. However, when a surface layer having high wear resistance is formed, the surface layer hardly wears, and hence the surface of the surface layer is hardly refreshed and chemical deterioration is liable to accumulate on the surface. The chemical deterioration is a phenomenon in which a hole-transporting substance (hole-transportable compound) present on the surface of the surface layer causes a chemical change owing to the stress caused by the series of electrophotographic processes. The chemical change of the substance forming the surface layer, such as the hole-transporting substance, may be a cause for a phenomenon in which an electrophotographic image output under a high-temperature and high-humidity environment becomes blurred (hereinafter sometimes referred to as "image smearing"). Therefore, the suppression of the image smearing requires the suppression of the chemical change of the substance forming the surface layer.

A technology involving incorporating an additive into the surface layer of the electrophotographic photosensitive member together with the hole-transporting substance is available as a method of improving the chemical stability of the hole-transporting substance. In Japanese Patent Application Laid-Open No. 2007-11005, there is a disclosure of a technology involving adding a specific fluorine atom-containing monomer having a polymerizable functional group to the surface layer of an electrophotographic photosensitive member to suppress image smearing. In Japanese Patent Application Laid-Open No. 2007-11006, there is a disclosure of a technology of providing an electrophotographic photosensitive member having imparted thereto a toner adhesion-preventing ability, an excellent cleaning property, and excellent transferability through the incorporation of a specific hole-transportable monomer containing a fluorine atom into the surface layer of the electrophotographic photosensitive member. In Japanese Patent Application Laid-Open No. 2016-51030, there is a disclosure of a technology of providing an electrophotographic photosensitive member that suppresses image smearing and is excellent in potential stability through the incorporation of a specific hole-transportable monomer containing a fluorine atom into the surface layer of the electrophotographic photosensitive member. In each of Japanese Patent Application Laid-Open No. 2007-272191, Japanese Patent Application Laid-Open No. 2007-272192, and Japanese Patent Application Laid-Open No. 2007-279678, there is a disclosure of a technology involving adding a specific amine compound to the surface layer of an electrophotographic photosensitive member to suppress image smearing. In Japanese Patent Application Laid-Open No. 2008-70761, there is a disclosure of a technology involving adding a specific siloxane compound having a specific polymerizable functional group to the surface layer of an electrophotographic photosensitive member to suppress image smearing. In Japanese Patent Application Laid-Open No. 2008-197632, there is a disclosure of a technology involving incorporating a specific polymerizable compound having a fluorine atom into the surface layer of an electrophotographic photosensitive member to suppress image smearing and a reduction in resolution.

A technology involving using any one of the compounds described in Japanese Patent Application Laid-Open No. 2007-11005, Japanese Patent Application Laid-Open No. 2007-272191, Japanese Patent Application Laid-Open No. 2007-272192, Japanese Patent Application Laid-Open No. 2007-279678, and Japanese Patent Application Laid-Open No. 2008-70761 is a technology for alleviating the exposure of the stress to the hole-transporting substance, and is not a technology of improving the chemical stability of the hole-transporting substance. In addition, in Japanese Patent Application Laid-Open No. 2007-11006, there is a description that the surface energy of the surface layer is reduced. However, there is no description concerning the deterioration of the electrophotographic photosensitive member, and there is no disclosure of the electrical characteristics thereof at the time of its long-term endurance under a specific environment. In Japanese Patent Application Laid-Open No. 2016-51030, there is no description concerning image density unevenness resulting from the charging unevenness of the electrophotographic photosensitive member under a specific environment.

In recent years, an improvement in durability of an electrophotographic photosensitive member has been significantly advancing, and hence there has been a growing demand for the suppression of image smearing. In order to suppress the image smearing, not only the alleviation of the exposure of the stress but also an improvement in chemical stability of the surface layer of the electrophotographic photosensitive member through the improvement of a substance forming the surface layer has been required. In addition, when the electrophotographic photosensitive member is used under a high-temperature and high-humidity environment for a long time period, the occurrence of an image defect due to the occurrence of the charging potential unevenness of the electrophotographic photosensitive member resulting from a reduction in resistance of the surface layer may be remarkable. Accordingly, the prevention of the image defect by the suppression of the occurrence of such charging unevenness has also been required.

SUMMARY OF THE INVENTION

Therefore, an object of the present invention is to provide an electrophotographic photosensitive member that has high durability, suppresses image smearing, and is suppressed in occurrence of charging unevenness, and an electrophotographic apparatus and a process cartridge each including the electrophotographic photosensitive member.

The object is achieved by the present invention described below. That is, according to one embodiment of the present invention, there is provided an electrophotographic photosensitive member including: an electroconductive support; and a photosensitive layer formed on the electroconductive support, wherein a surface layer of the electrophotographic photosensitive member contains a copolymer of a hole-transportable compound having a polymerizable functional group and a compound represented by the following general formula (1):

$$Ar^1\text{-}(L^1\text{-}P^1)_m \quad (1)$$

in the formula (1), $Ar^1$ represents a group obtained by removing m hydrogen atoms in a compound represented by the following formula (2), $L^1$ represents a divalent group represented by the formula (3) or the formula (4), $P^1$ represents a polymerizable functional group, and m represents an integer of from 1 to 4, and when m represents 2 or more, $L^1$'s may be identical to or different from each other, and P's may be identical to or different from each other;

$$R^1\text{—}R^2\text{—}R^3 \quad (2)$$

in the formula (2), $R^1$ and $R^3$ each independently represent a substituted or unsubstituted phenyl group, or a substituted or unsubstituted biphenylyl group, and $R^2$ represents a single bond, a substituted or unsubstituted phenylene group, or a substituted or unsubstituted biphenylylene group, and substituents of the phenyl group, the biphenylyl group, the phenylene group, and the biphenylylene group are each selected from a fluorine atom, a fluorinated alkyl group having 1 to 6 carbon atoms, a fluorinated alkoxy group having 1 to 6 carbon atoms, an alkyl group having 1 to 6 carbon atoms, and an alkoxy group having 1 to 6 carbon atoms, and at least one of $R^1$ to $R^3$ has at least one substituent selected from the group consisting of the fluorine atom, the fluorinated alkyl group having 1 to 6 carbon atoms, and the fluorinated alkoxy group having 1 to 6 carbon atoms;

$$(R^4)_n \quad (3)$$

$$(O\text{—}R^5)_q \quad (4)$$

in the formula (3), $R^4$ represents an alkylene group having 1 to 6 carbon atoms, and n represents 0 or 1;
in the formula (4), $R^5$ represents an alkylene group having 1 to 6 carbon atoms, and q represents an integer of from 1 to 4.

According to another embodiment of the present invention, there is provided a process cartridge including: the electrophotographic photosensitive member; and at least one unit selected from the group consisting of a charging unit, a developing unit, and a cleaning unit, the electrophotographic photosensitive member and the at least one unit being integrally supported, wherein the process cartridge is removably mounted onto a main body of an electrophotographic apparatus.

According to still another embodiment of the present invention, there is provided an electrophotographic apparatus including: the electrophotographic photosensitive member; a charging unit; an exposing unit; a developing unit; and a transferring unit.

According to the present invention, the electrophotographic photosensitive member that effectively suppresses image smearing and effectively suppresses the occurrence of image density unevenness resulting from charging unevenness under a high-temperature and high-humidity environment, and the electrophotographic apparatus including the electrophotographic photosensitive member and the process cartridge including the electrophotographic photosensitive member can be provided.

Further features of the present invention will become apparent from the following description of exemplary embodiments with reference to the attached drawings.

DESCRIPTION OF THE EMBODIMENTS

Figure 1:
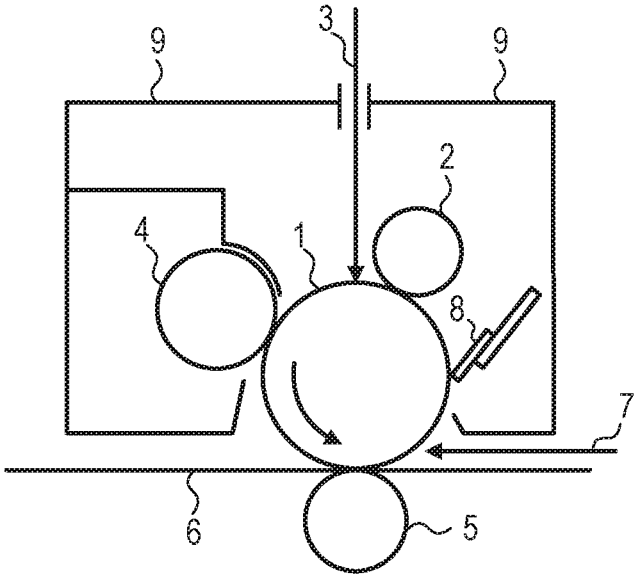
FIG. 1 is a schematic view for illustrating an example of a process cartridge including an electrophotographic photosensitive member.

Preferred embodiments of the present invention will now be described in detail in accordance with the accompanying drawings.

An electrophotographic photosensitive member of the present invention is an electrophotographic photosensitive member including: an electroconductive support; and a photosensitive layer formed on the electroconductive support, wherein a surface layer of the electrophotographic photosensitive member contains a copolymer of a hole-transportable compound having a polymerizable functional group and a compound represented by the general formula (1). In addition, the electrophotographic photosensitive member has a feature in that at least one aromatic group of the compound represented by the general formula (1) has a substituent selected from the group consisting of a fluorine atom, a fluorinated alkyl group having 1 to 6 carbon atoms, and a fluorinated alkoxy group having 1 to 6 carbon atoms. The fluorinated alkyl group having 1 to 6 carbon atoms and the fluorinated alkoxy group having 1 to 6 carbon atoms serving as substituents are hereinafter sometimes collectively referred to as "fluorine-containing substituents". Additionally, moieties having "1 to 6 carbon atoms" are hereinafter sometimes referred to as "$C_{1-6}$" moieties.

$$Ar^1\text{-}(L^1\text{-}P^1)_m \quad (1)$$

$$Ar^1\text{-}(L^1\text{-}P^1)_m \quad (1)$$

In the formula (1), $Ar^1$ represents a group obtained by removing m hydrogen atoms in a compound represented by the following formula (2), $L^1$ represents a divalent group represented by the formula (3) or the formula (4), $P^1$ represents a polymerizable functional group, and m represents an integer of from 1 to 4, and when m represents 2 or more, $L^1$'s may be identical to or different from each other, and $P^1$'s may be identical to or different from each other.

$$R^1\text{—}R^2\text{—}R^3 \quad (2)$$

In the formula (2), $R^1$ and $R^3$ each independently represent a substituted or unsubstituted phenyl group, or a substituted or unsubstituted biphenylyl group, and $R^2$ represents a single bond, a substituted or unsubstituted phenylene group, or a substituted or unsubstituted biphenylylene group, and substituents of the phenyl group, the biphenylyl group, the phenylene group, and the biphenylylene group are each selected from a fluorine atom, a fluorinated alkyl group having 1 to 6 carbon atoms, a fluorinated alkoxy group having 1 to 6 carbon atoms, an alkyl group having 1 to 6 carbon atoms, and an alkoxy group having 1 to 6 carbon atoms, and at least one of $R^1$ to $R^3$ has a substituent selected from the group consisting of the fluorine atom, the fluorinated alkyl group having 1 to 6 carbon atoms, and the fluorinated alkoxy group having 1 to 6 carbon atoms.

$$-(R^4)-_n \quad (3)$$

$$-(O-R^5)-_q \quad (4)$$

In the formula (3), $R^4$ represents an alkylene group having 1 to 6 carbon atoms, and n represents 0 or 1.

In the formula (4), $R^5$ represents an alkylene group having 1 to 6 carbon atoms, and q represents an integer of from 1 to 4.

<Compound Represented by General Formula (1)>

It is conceivable that the compound represented by the general formula (1) copolymerizes with the hole-transportable compound having the polymerizable functional group to make a fluorine atom or a fluorine-containing substituent compatible with the entirety of the surface layer, and hence can suppress the deterioration of the surface layer, and at the same time, can also suppress the deterioration of the hole-transportable compound.

This is probably because when the compound represented by the general formula (1) has a fluorine atom or a fluorine-containing substituent in a specific portion, the compound moderately reduces the surface energy of the surface layer of the photosensitive member, and is improved in hydrophobicity to alleviate its affinity for moisture, a discharge product, or the like.

In addition, a structure represented by $Ar^1$ of the compound represented by the general formula (1) is an oligophenyl structure in which 2 to 6 benzene rings are linked to each other through a single bond, provided that the oligophenyl structure does not include a compound in which benzene rings are linked to each other through a single bond in a ring manner. The inventors of the present invention have assumed that even when the compound represented by the general formula (1) has a fluorine atom or a fluorine-containing substituent, excessive phase separation of the compound from an application liquid for a surface layer, the migration thereof from the liquid to the surface of the electrophotographic photosensitive member, or the like hardly occurs at the time of the formation of the surface layer by virtue of the structural feature. The inventors have considered that as a result of the foregoing, the hole-transportable compound having the polymerizable functional group and the compound represented by the general formula (1) can be uniformly incorporated into the entirety of the surface layer.

Meanwhile, when a general polymerizable compound having a fluorinated alkyl group or the like, which has been described in related art or the like, is used, the compound is liable to cause phase separation with the hole-transportable compound having the polymerizable functional group, and hence an effect at the time of their mixing cannot be sufficiently expressed in some cases.

Accordingly, the inventors have considered that in order that the compound represented by the general formula (1) may be more suitably dispersed in the surface layer to be uniformly present therein, there is a structure optimum for the oligophenyl structure.

The inventors have made an investigation, and as a result, have revealed that the oligophenyl structure represented by $Ar^1$ in the compound represented by the general formula (1) is preferably a structure formed of 4 or less benzene rings, that is, the structure represented by $Ar^1$ of the general formula (1) is preferably a quaterphenyl structure having 4 benzene rings, a terphenyl structure having 3 benzene rings, or a biphenyl structure having 2 benzene rings. Further, the inventors have found that the structure represented by $Ar^1$ of the general formula (1) is more preferably a biphenyl structure or a terphenyl structure.

When the number of the benzene rings in the oligophenyl structure represented by $Ar^1$ of the general formula (1) is 7 or more, compatibility between the compound represented by the general formula (1) and the hole-transportable compound having the polymerizable functional group deteriorates to cause, for example, phase separation therebetween, and hence the film strength of the surface layer reduces in some cases. In addition, when the number of the benzene rings is 0 or 1, for example, the following risk arises: phase separation, such as the migration of the compound represented by the general formula (1) to the surface, is liable to occur, and as a result, a target effect does not continue at the time of the endurance use of the electrophotographic photosensitive member.

In addition, the oligophenyl structure represented by $Ar^1$ of the general formula (1) preferably has a bent structure. The structure preferably contains a m-terphenyl structure or an o-terphenyl structure out of the terphenyl structures. The structure preferably has a structure in which one phenyl group is further bonded to a m-terphenyl or o-terphenyl structure having flexibility in its molecular shape out of the quaterphenyl structures. This is probably because a bent structure improves the compatibility of the compound represented by the general formula (1) with the hole-transportable compound having the polymerizable functional group to be simultaneously used.

Meanwhile, a p-terphenyl structure or p-quaterphenyl structure in which all benzene rings are bonded at p-positions may not be very proper because the compatibility of the compound represented by the general formula (1) with a peripheral material, such as the hole-transportable compound having the polymerizable functional group, reduces.

The structure represented by $Ar^1$ of the compound represented by the general formula (1) has at least one fluorine atom, fluorinated alkyl group having 1 to 6 carbon atoms, or fluorinated alkoxy group having 1 to 6 carbon atoms as a substituent. In addition, the structure may be substituted with an alkyl group having 1 to 6 carbon atoms or an alkoxy group having 1 to 6 carbon atoms in addition to the foregoing.

The fluorinated alkyl group having 1 to 6 carbon atoms serving as a substituent may be a linear or branched fluorinated alkyl group. Examples of the fluorinated alkyl group include a monofluoromethyl group, a difluoromethyl group, a trifluoromethyl group, a 1,1-difluoroethyl group, a 2,2,2-trifluoroethyl group, a 1,2,2-trifluoroethyl group, a 1,1,2,2-tetrafluoroethyl group, a 1,1,2,2,2-pentafluoroethyl group, a 1,1-difluoropropyl group, a 3,3,3-trifluoropropyl group, a 2,2,3,3,3-pentafluoropropyl group, a 4,4,4-trifluorobutyl group, a 3,3,4,4,4-pentafluorobutyl group, a 1,1-difluoropentyl group, a 5,5,5-trifluoropentyl group, a 4,4,5,5,5-pentafluoropentyl group, a 1,1-difluorohexyl group, a 6,6,6-trifluorohexyl group, a 5,5,6,6,6-pentafluorohexyl group, and a 4,4,5,5,6,6,6-heptafluorohexyl group.

The fluorinated alkoxy group having 1 to 6 carbon atoms serving as a substituent may be a linear or branched fluorinated alkoxy group. Examples of the fluorinated alkoxy group include a monofluoromethoxy group, a difluoromethoxy group, a trifluoromethoxy group, a 1,1-difluoroethoxy group, a 2,2,2-trifluoroethoxy group, a 1,1,2,2,2-pentafluoroethoxy group, a 1,1-difluoropropoxy group, a 3,3,3-trifluoropropoxy group, a 2,2,3,3,3-pentafluoropropoxy group, a 4,4,4-trifluorobutoxy group, a 3,3,4,4,4-pentafluorobutoxy group, a 5,5,5-trifluoropentyloxy group, and a 6,6,6-trifluorohexyloxy group.

The alkyl group having 1 to 6 carbon atoms serving as a substituent may be a linear or branched alkyl group. Examples of the alkyl group include a methyl group, an ethyl group, a n-propyl group, an isopropyl group, a n-butyl group, an isobutyl group, a sec-butyl group, a tert-butyl group, a n-pentyl group, an isopentyl group, a neopentyl group, a tert-pentyl group, a cyclopentyl group, a n-hexyl group, a 1-methylpentyl group, a 4-methyl-2-pentyl group, a 3,3-dimethylbutyl group, a 2-ethylbutyl group, and a cyclohexyl group.

The alkoxy group having 1 to 6 carbon atoms serving as a substituent may be a linear or branched alkoxy group. Examples of the alkoxy group include a methoxy group, an ethoxy group, a n-propoxy group, an isopropoxy group, a n-butoxy group, an isobutoxy group, a sec-butoxy group, a tert-butoxy group, a n-pentyloxy group, and a n-hexyloxy group.

Of those, a substituent having 1 to 4 carbon atoms is preferred as the substituent.

The compound represented by the general formula (1) has a polymerizable functional group represented by $P^1$ on the structure represented by $Ar^1$. Although the substitution position of the polymerizable functional group represented by $P^1$ may be any position of the structure represented by $Ar^1$, the position is preferably a position of a benzene ring positioned at a terminal of the oligophenyl structure. Further, a structure in which one polymerizable functional group is introduced into one benzene ring is preferred.

In addition, when the number m of the polymerizable functional groups each represented by $P^1$ represents an integer of from 2 to 4, that is, when the compound represented by the general formula (1) has 2 to 4 polymerizable functional groups each represented by $P^1$, the film strength of the surface layer is improved. When m represents 5 or more, shrinkage or a stress change in association with a polymerization reaction of the compounds represented by the general formula (1) and/or the hole-transportable compounds may become larger to cause a problem in the formation of the surface layer. m preferably represents 1 or 2 from the viewpoints of the film formability and film strength of the surface layer.

In addition, the compound represented by the general formula (1) is preferably of such a structure as to efficiently perform the polymerization reaction in a production process for the surface layer of the electrophotographic photosensitive member of the present invention. Accordingly, the compound preferably has a connecting group represented by $L^1$, which is an alkylene group represented by the formula (3) or an oxyalkylene group represented by the formula (4), between the structure represented by $Ar^1$ and the polymerizable functional group represented by $P^1$.

The alkylene group having 1 to 6 carbon atoms represented by $R^4$ or $R^5$ in each of the alkylene group represented by the formula (3) and the oxyalkylene group represented by the formula (4) may be a linear or branched alkylene group. Examples of the alkylene group include a methylene group, an ethylene group, a propylene group, a butylene group, a pentylene group, a hexylene group, a 1-methylethylene group, a 2-methylethylene group, a 1-methylpropylene group, a 2-methylpropylene group, a 3-methylpropylene group, a 1-methylbutylene group, a 2-methylbutylene group, a 3-methylbutylene group, a 4-methylbutylene group, a 1-methylpentylene group, a 2-methylpentylene group, a 3-methylpentylene group, a 4-methylpentylene group, a 5-methylpentylene group, a 1,1-dimethylethylene group, a 1,2-dimethylethylene group, a 2,2-dimethylethylene group, a 1,1-dimethylpropylene group, a 1,2-dimethylpropylene group, a 1,3-dimethylpropylene group, a 2,2-dimethylpropylene group, a 2,3-dimethylpropylene group, a 3,3-dimethylpropylene group, a 1,1-dimethylbutylene group, a 1,2-dimethylbutylene group, a 1,3-dimethylbutylene group, a 1,4-dimethylbutylene group, a 2,2-dimethylbutylene group, a 2,3-dimethylbutylene group, a 2,4-dimethylbutylene group, a 3,3-dimethylbutylene group, a 3,4-dimethylbutylene group, and a 4,4-dimethylbutylene group.

When the structure of the connecting group represented by $L^1$ becomes excessively long, the film strength, electrical characteristics, and the like of the surface layer reduce. Accordingly, $R^4$ and $R^5$ each preferably represent an alkylene group or oxyalkylene group having 1 to 6 carbon atoms. That is, the compound represented by the general formula (1) is preferably a compound represented by the following formula (5) or the following formula (6). Further, $R^4$ and $R^5$ each more preferably represent an alkylene group or oxyalkylene group having 2 to 5 carbon atoms.

$$Ar^1\text{-}(\text{-}R^4\text{—}P^1)_m \tag{5}$$

$$Ar^1\text{-}(\text{-}O\text{—}R^5\text{—}P^1)_m \tag{6}$$

In the formula (5) and the formula (6), $Ar^1$, $P^1$, and m are identical in meaning to those in the formula (1), $R^4$ is identical in meaning to that in the formula (3), and $R^5$ is identical in meaning to that in the formula (4).

The polymerizable functional group represented by $P^1$ in the general formula (1) is a functional group that can form a covalent bond when a reaction occurs between molecules having polymerizable functional groups. Examples thereof include reactive functional groups shown below. When the compound represented by the general formula (1) has a plurality of polymerizable functional groups each represented by $P^1$, the plurality of polymerizable functional groups each represented by $P^1$ may be different from each other in a molecule thereof. In addition, the surface layer of the electrophotographic photosensitive member of the present invention may be a surface layer containing one kind of compound represented by the general formula (1), or may contain a plurality of kinds of such compound.

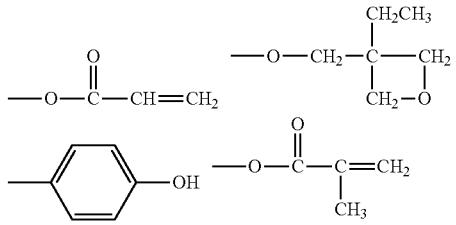

-continued

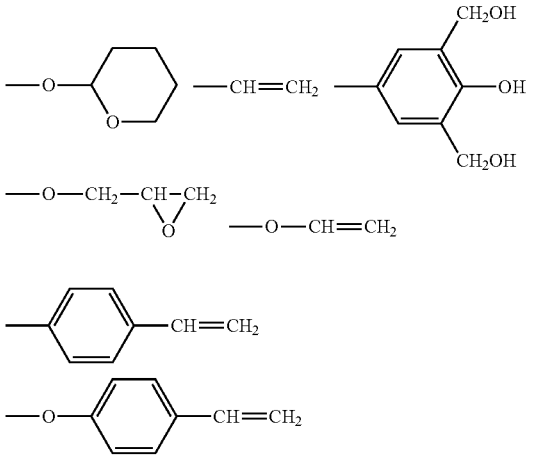

The polymerizable functional group represented by $P^1$ in the general formula (1) is preferably a polymerizable functional group containing an acryloyloxy group, a methacryloyloxy group, an epoxy group, an oxetanyl group, a styryl group, or a methylolated phenol group from the viewpoints of the film strength and wear resistance of the surface layer. In addition, an acryloyloxy group or a methacryloyloxy group serving as a chain polymerizable functional group is particularly preferred from the viewpoints of, for example, polymerizability and a polymerization rate.

A method involving applying energy, such as UV light, an electron beam, or heat, or a chemical method involving causing an auxiliary agent, such as a polymerization initiator, and a compound, such as an acid, an alkali, or a complex, to coexist may be used as a method of subjecting the polymerizable functional group to a polymerization reaction.

Further, it is preferred that the compound represented by the general formula (1) have one or two polymerizable functional groups each represented by $P^1$, that is, m in the general formula (1) represent 2 or less.

Exemplified compounds of the compound represented by the general formula (1) are shown below. In the present invention, however, the compound represented by the general formula (1) is not limited thereto. In addition, the polymerizable functional groups of the exemplified compounds may each be replaced with any one of the above-mentioned polymerizable functional groups, and substituents in the exemplified compounds may each be replaced, or further substituted, with any one of the above-mentioned substituents.

Exemplified Compound No. 1

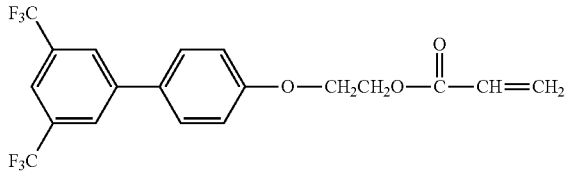

Exemplified Compound No. 2

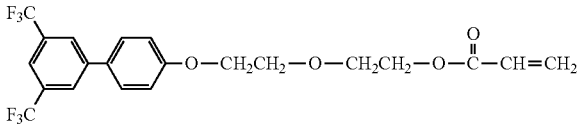

Exemplified Compound No. 3

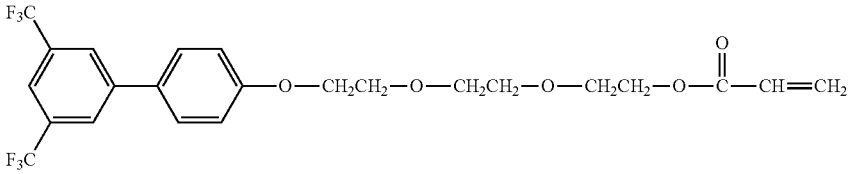

Exemplified Compound No. 4

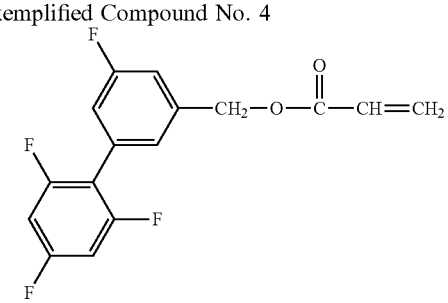

Exemplified Compound No. 5

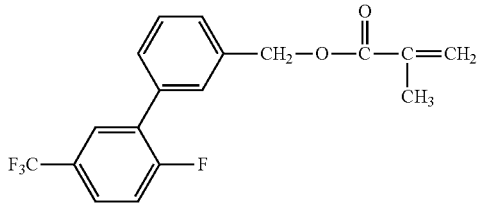

Exemplified Compound No. 6

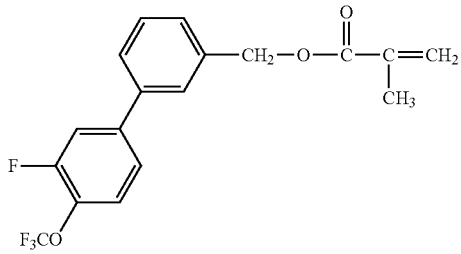

Exemplified Compound No. 7
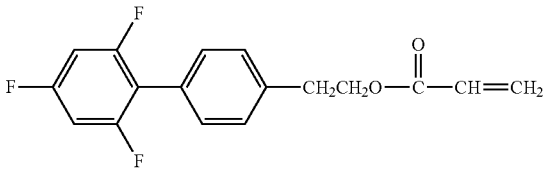
Exemplified Compound No. 8
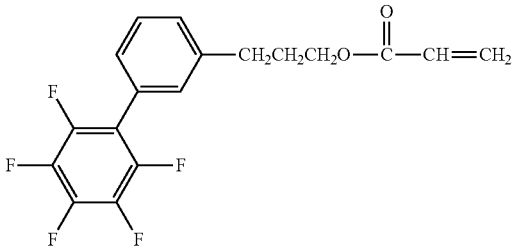
Exemplified Compound No. 9
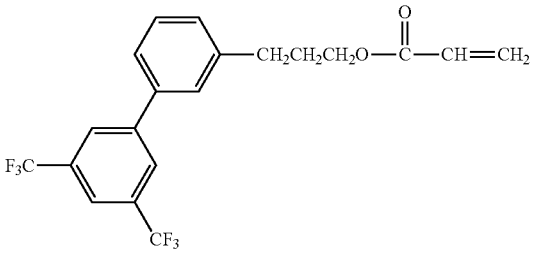
Exemplified Compound No. 10
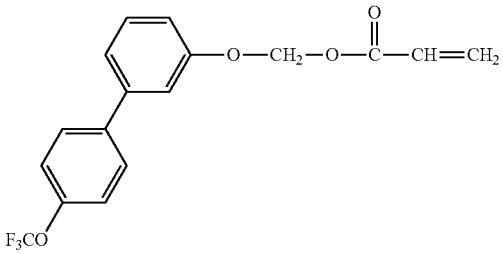
Exemplified Compound No. 11
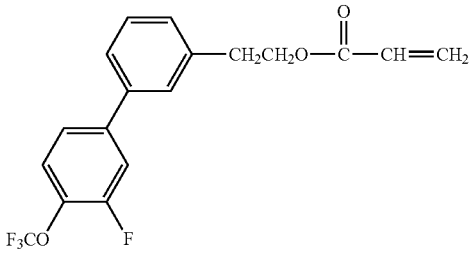
Exemplified Compound No. 12
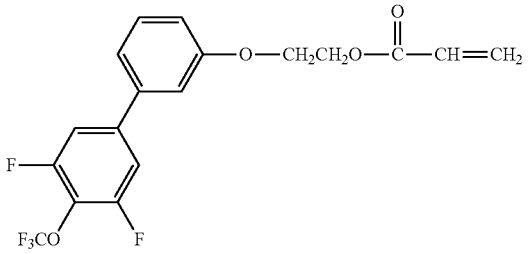
Exemplified Compound No. 13
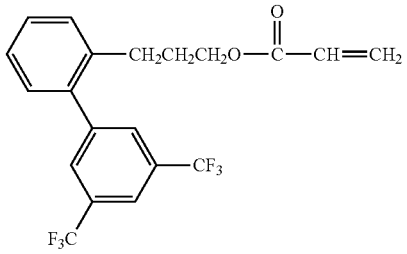
Exemplified Compound No. 14
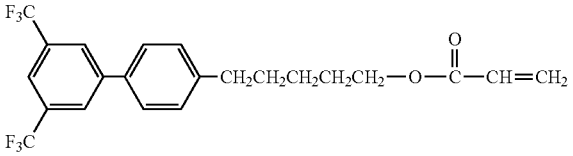
Exemplified Compound No. 15
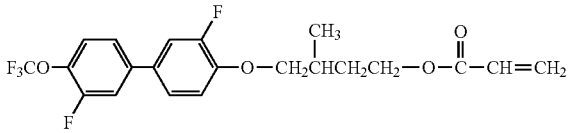

Exemplified Compound No. 16
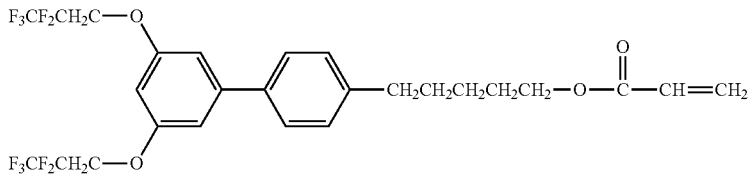
Exemplified Compound No. 17
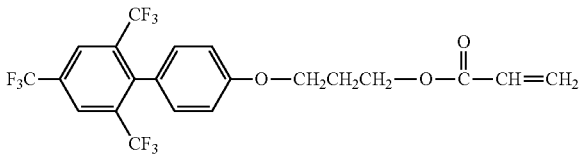
Exemplified Compound No. 18
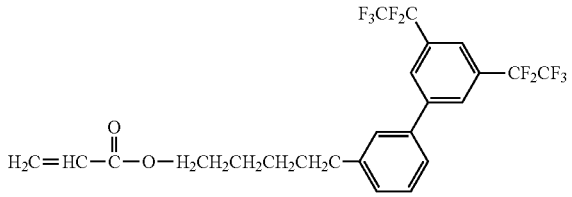
Exemplified Compound No. 19
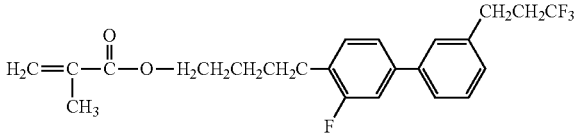
Exemplified Compound No. 20
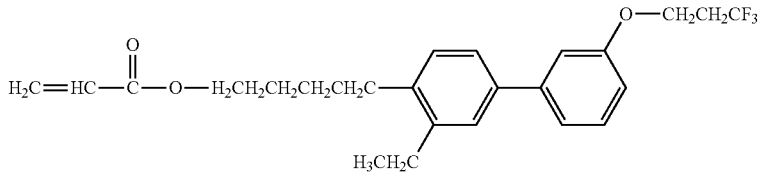
Exemplified Compound No. 21
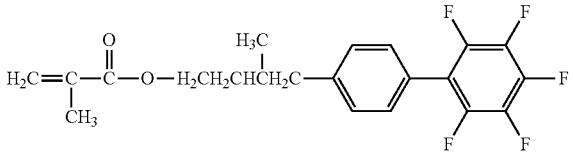

Exemplified Compound No. 22
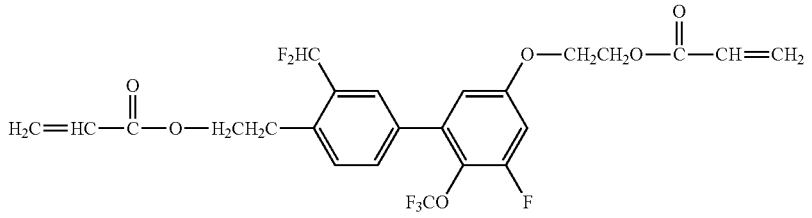
Exemplified Compound No. 23
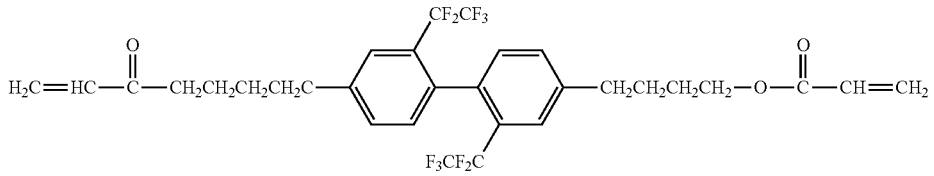
Exemplified Compound No. 24
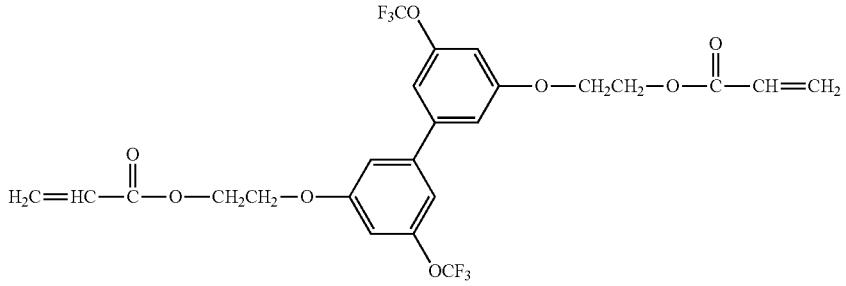
Exemplified Compound No. 25
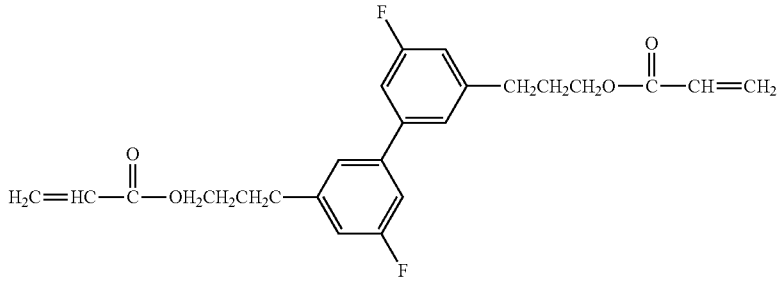
Exemplified Compound No. 26
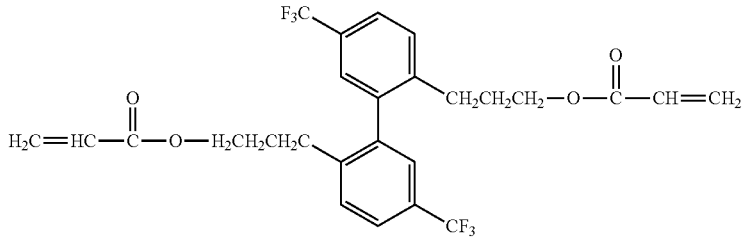

Exemplified Compound No. 27
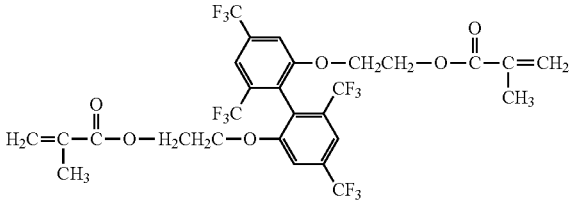
Exemplified Compound No. 28
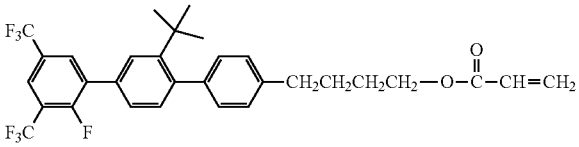
Exemplified Compound No. 29
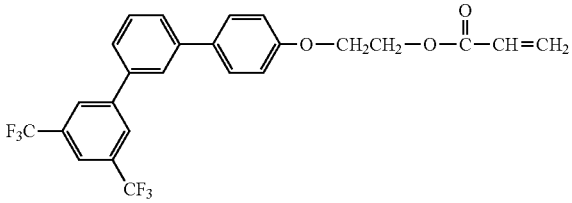
Exemplified Compound No. 30
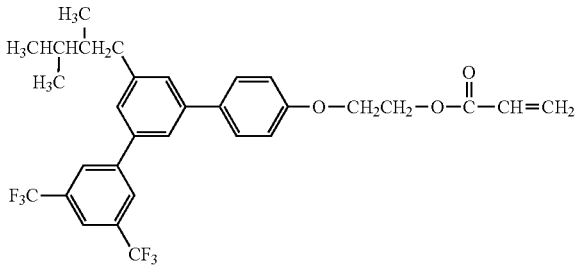
Exemplified Compound No. 31
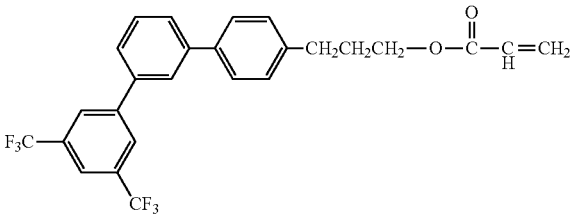
Exemplified Compound No. 32
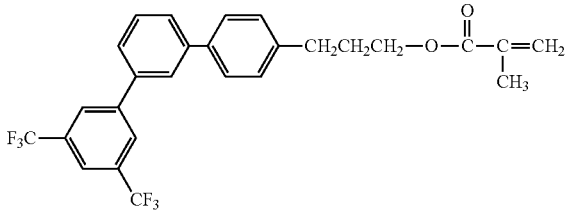
Exemplified Compound No. 33
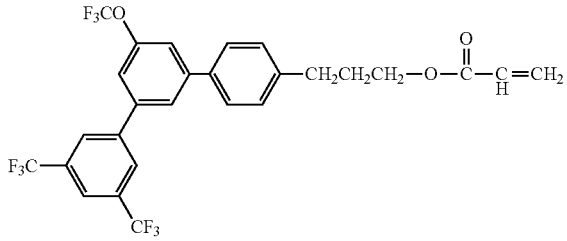
Exemplified Compound No. 34
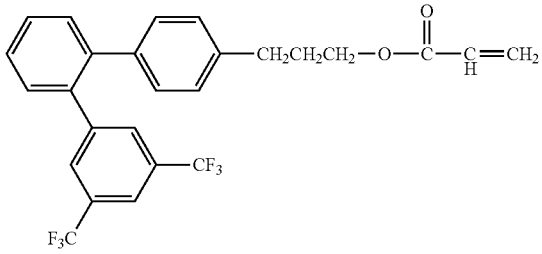
Exemplified Compound No. 35
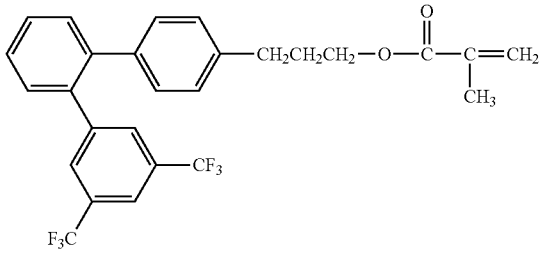
Exemplified Compound No. 36
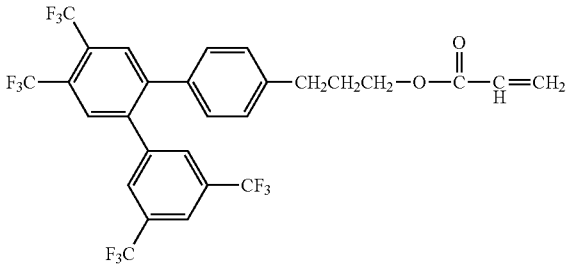

Exemplified Compound No. 37
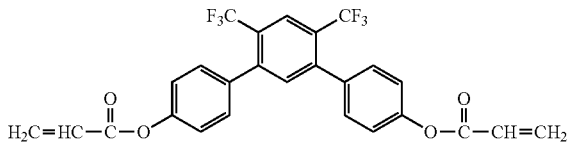
Exemplified Compound No. 38
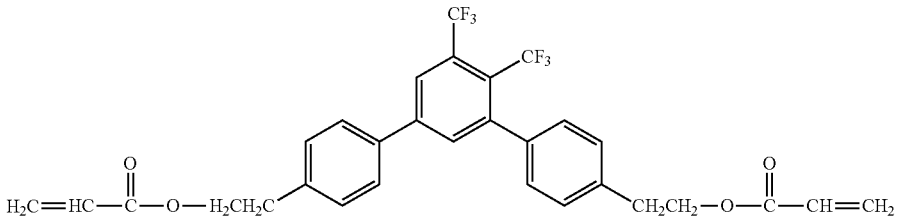
Exemplified Compound No. 39
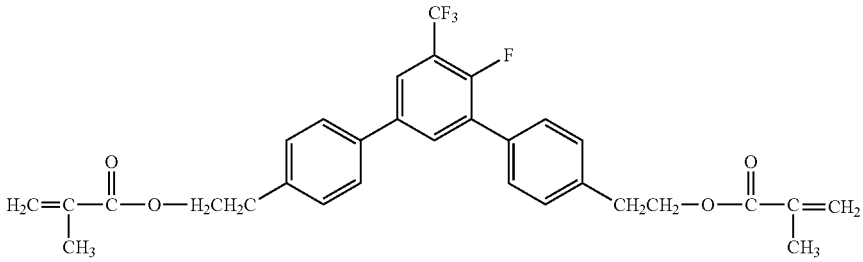
Exemplified Compound No. 40
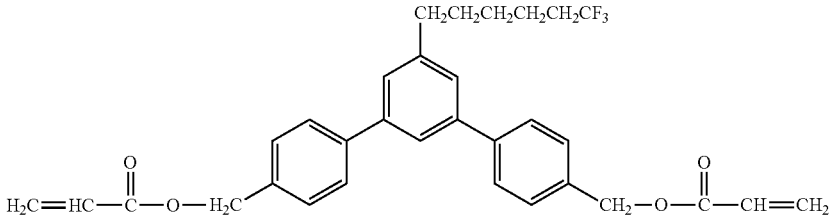
Exemplified Compound No. 41
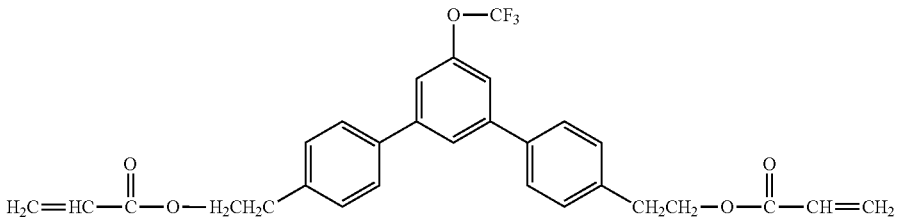

Exemplified Compound No. 42
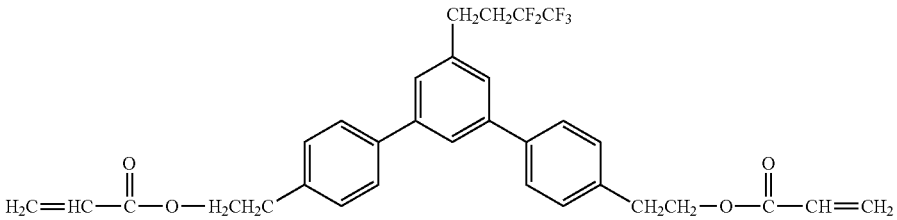
Exemplified Compound No. 43
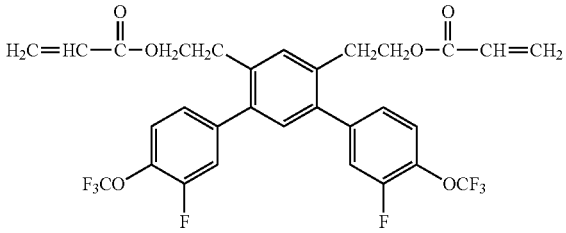
Exemplified Compound No. 44
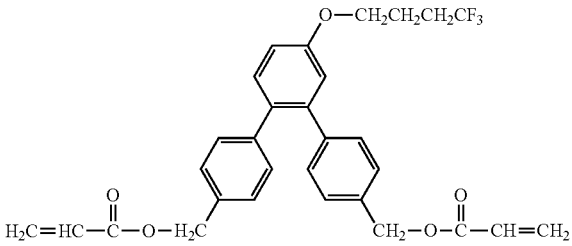
Exemplified Compound No. 45
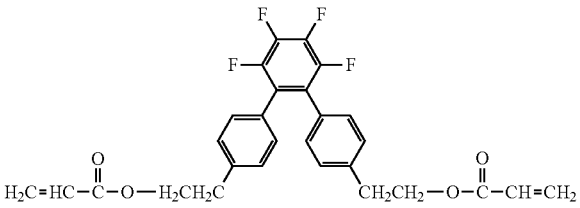
Exemplified Compound No. 46
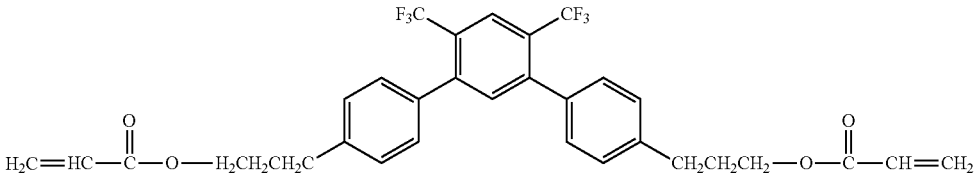

Exemplified Compound No. 47
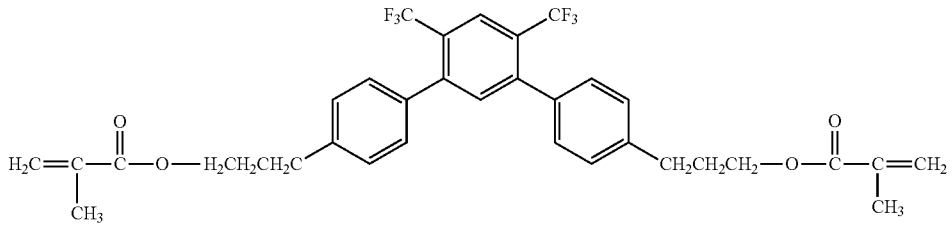
Exemplified Compound No. 48
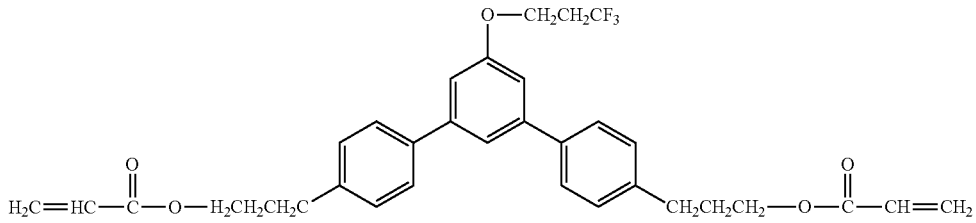
Exemplified Compound No. 49
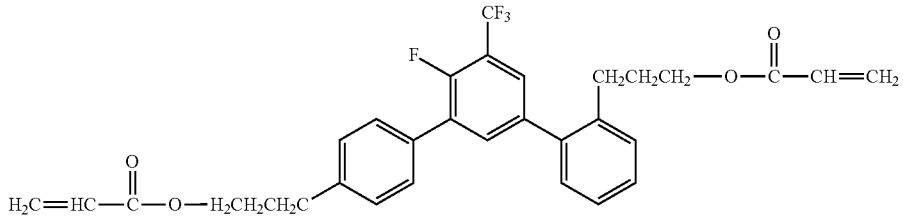
Exemplified Compound No. 50
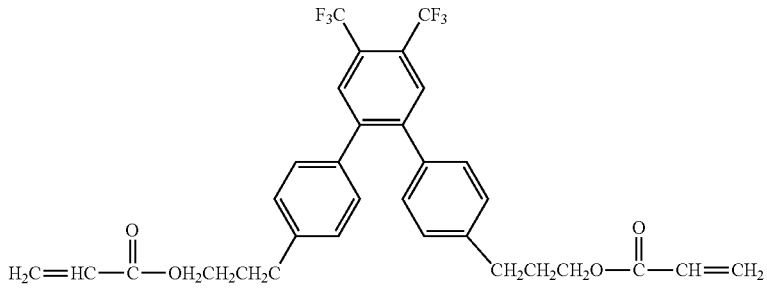
Exemplified Compound No. 51
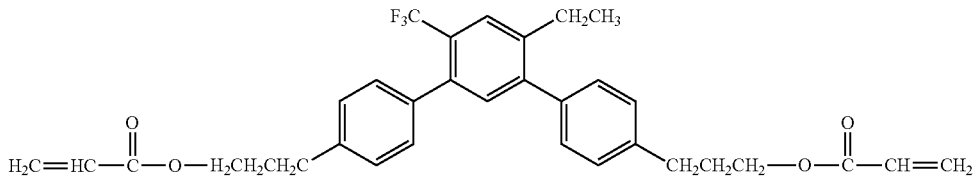

Exemplified Compound No. 52
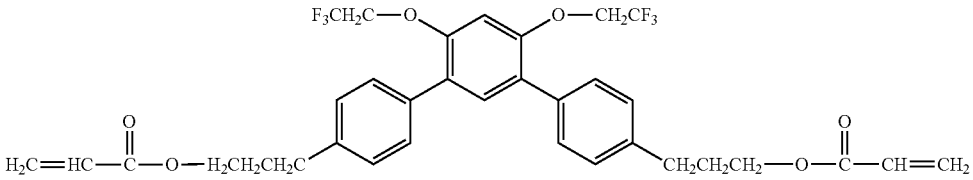
Exemplified Compound No. 53
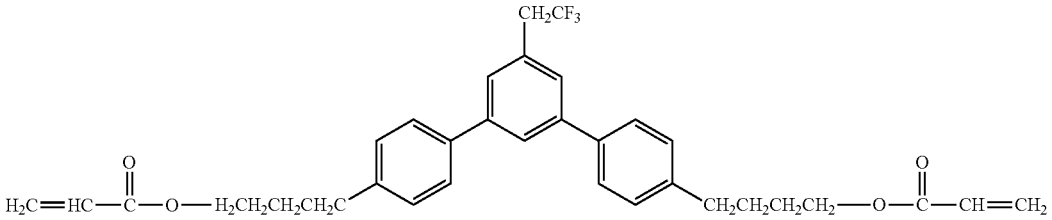
Exemplified Compound No. 54
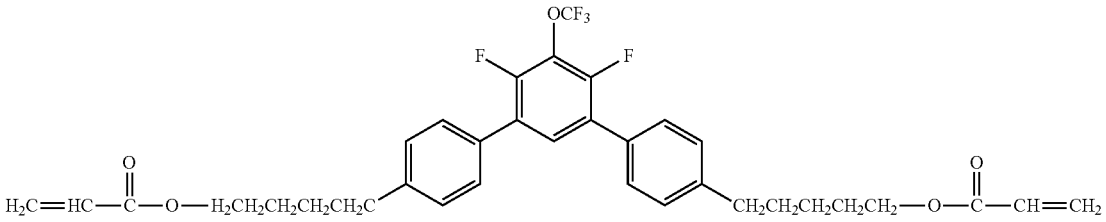
40
Exemplified Compound No. 55
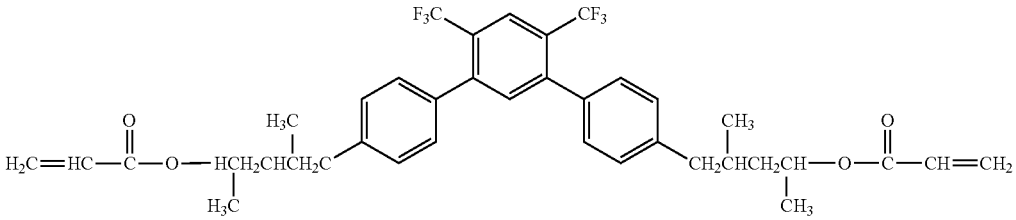
Exemplified Compound No. 56
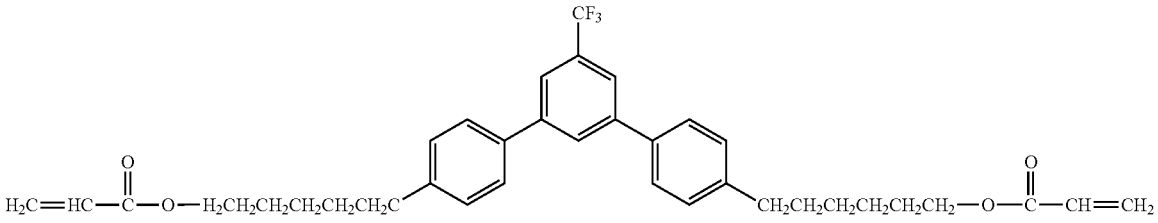

Exemplified Compound No. 57
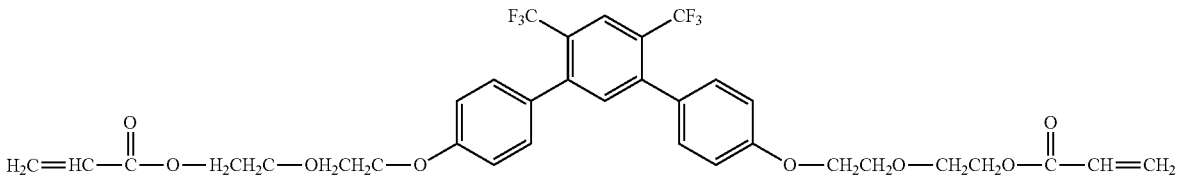
Exemplified Compound No. 58
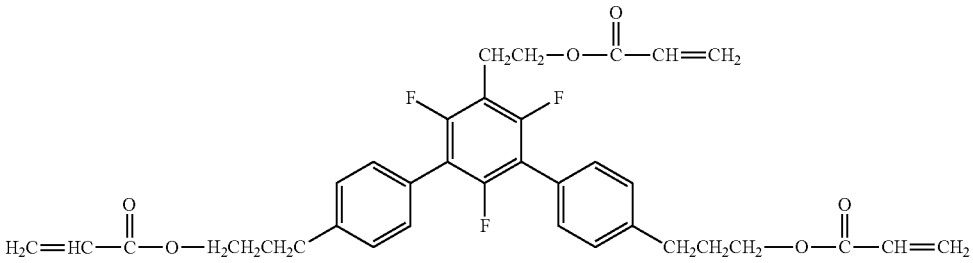
Exemplified Compound No. 59
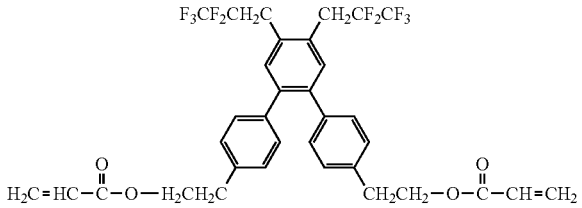
Exemplified Compound No. 60
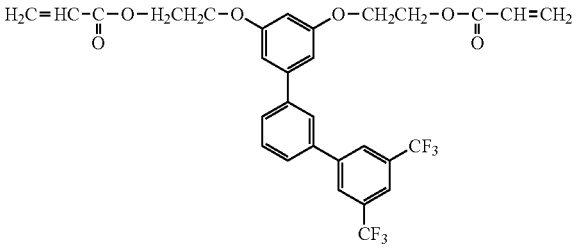
Exemplified Compound No. 61
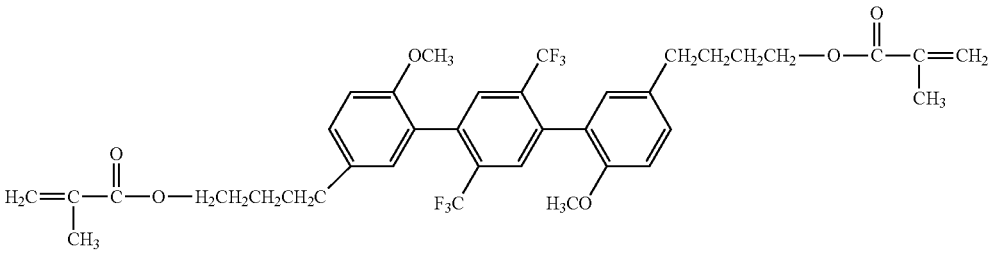

Exemplified Compound No. 62
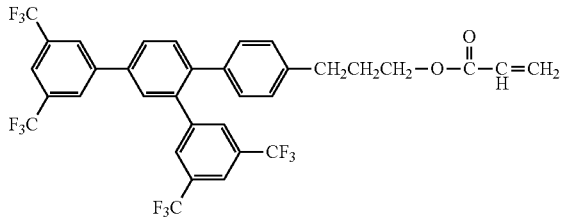
Exemplified Compound No. 63
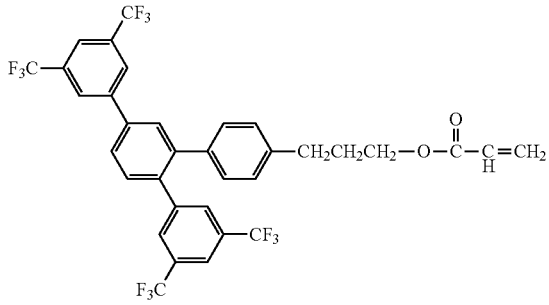
Exemplified Compound No. 64
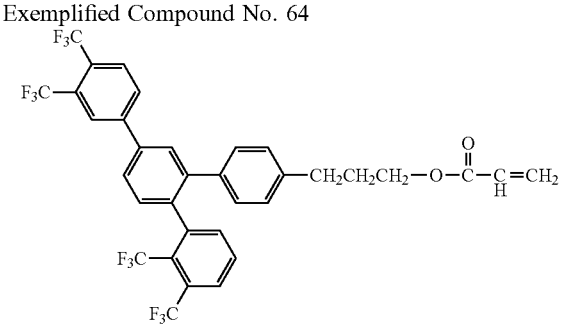
Exemplified Compound No. 65
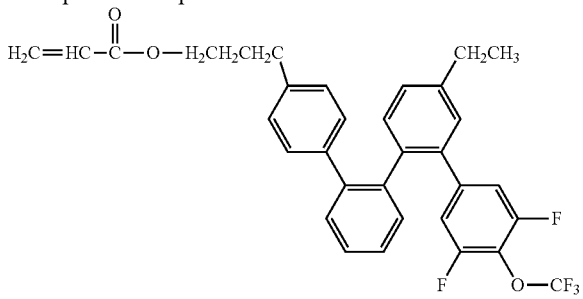
Exemplified Compound No. 66
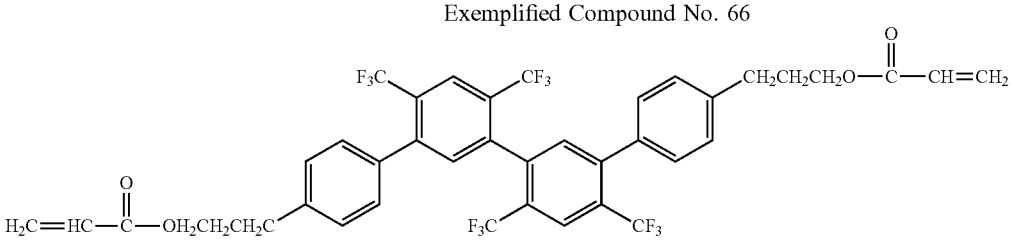
Exemplified Compound No. 67
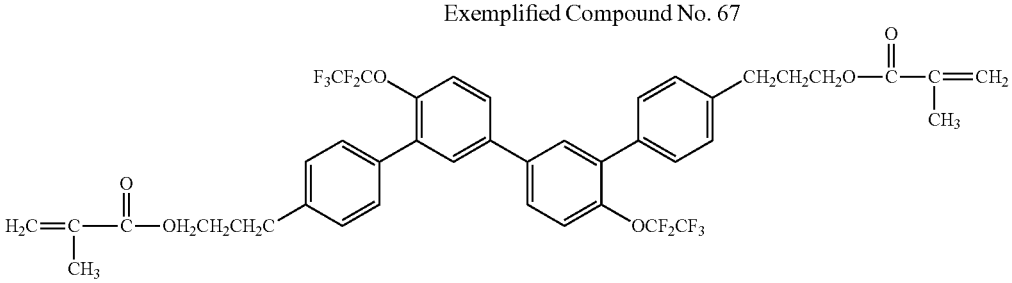
Exemplified Compound No. 68
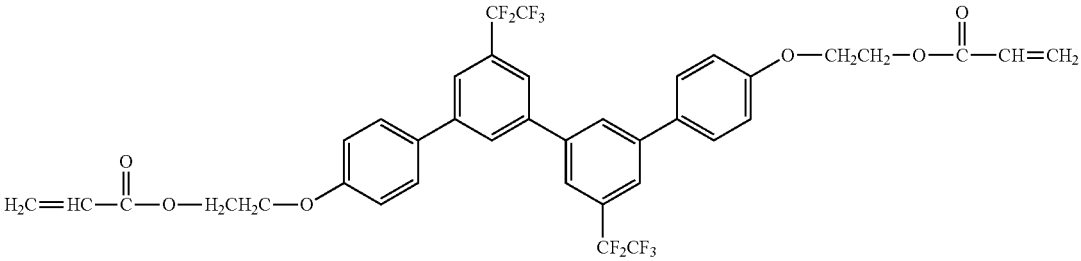

Exemplified Compound No. 69
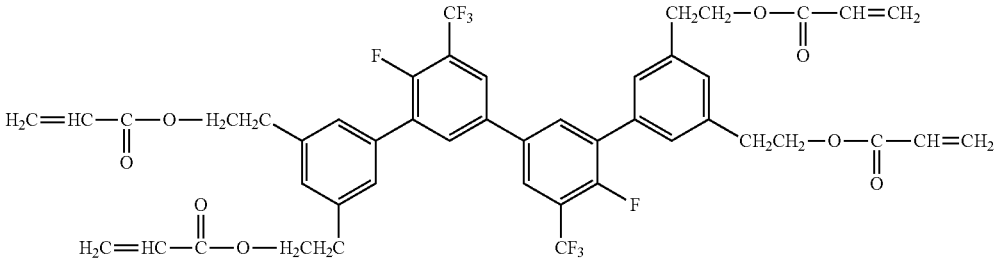
Exemplified Compound No. 70
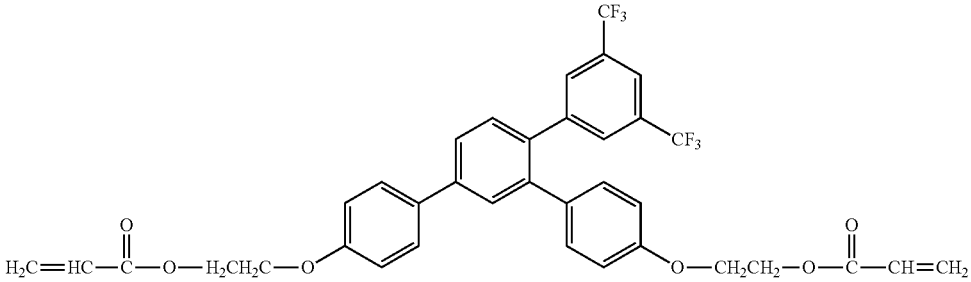
Exemplified Compound No. 71
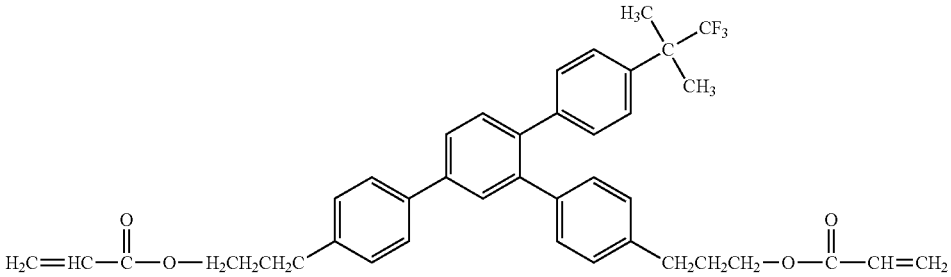
50
Exemplified Compound No. 72
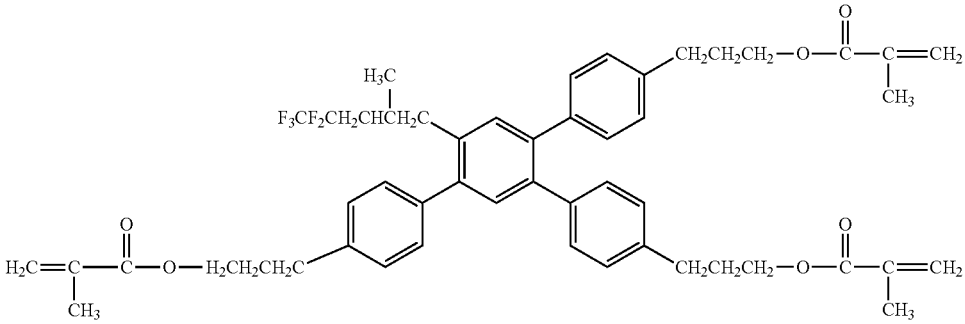

Exemplified Compound No. 73
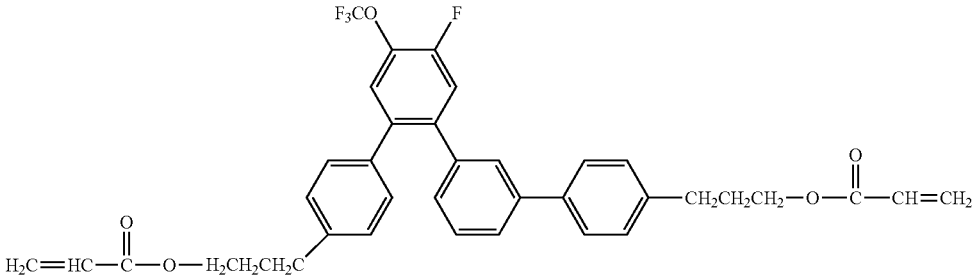
Exemplified Compound No. 74
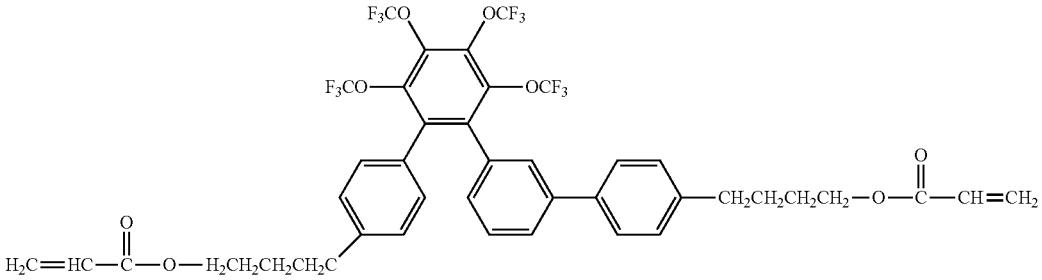
Exemplified Compound No. 75
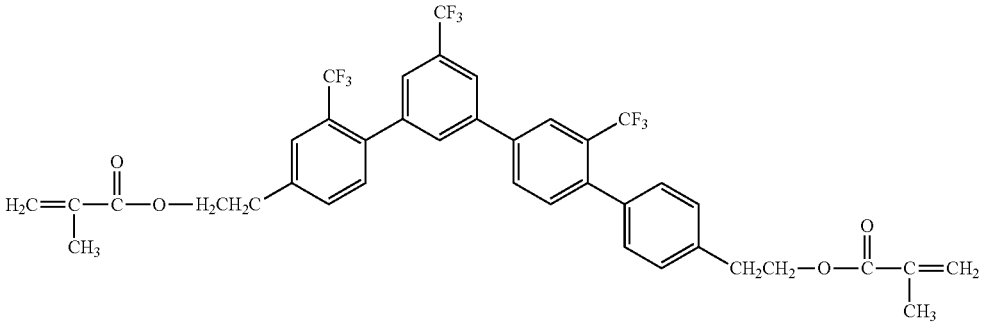
Exemplified Compound No. 76
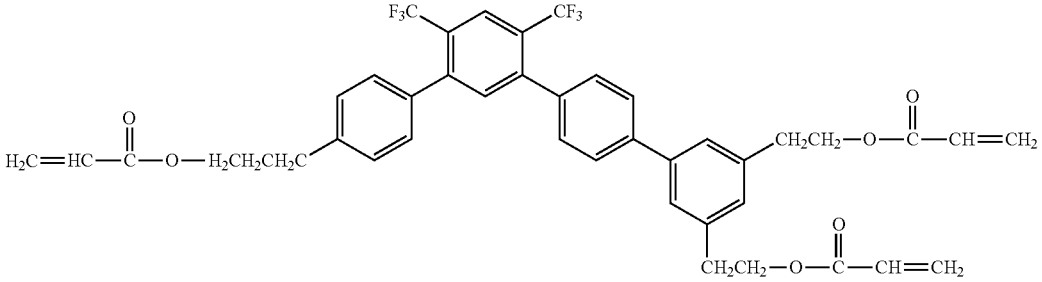

Exemplified Compound No. 77
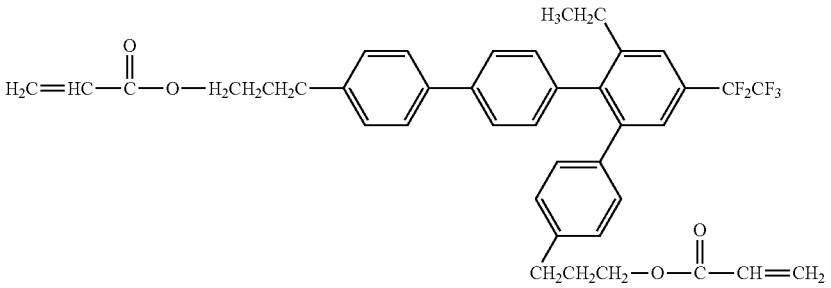
Exemplified Compound No. 78
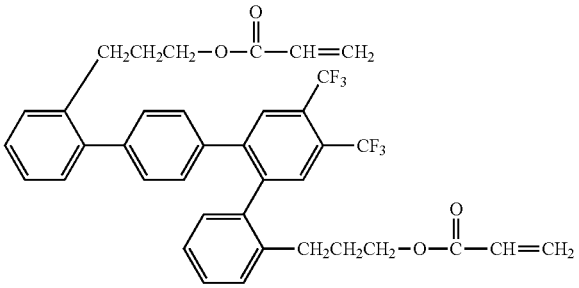
Exemplified Compound No. 79
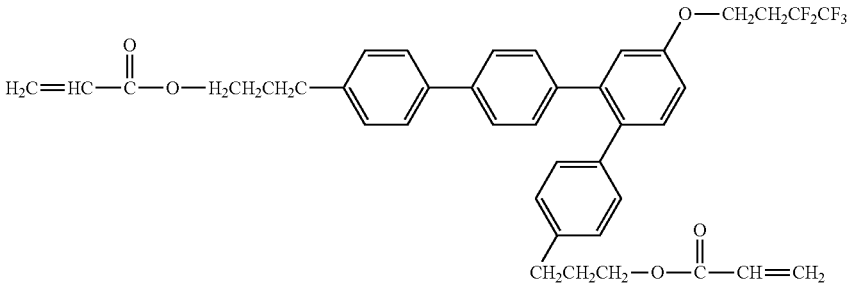
Exemplified Compound No. 80
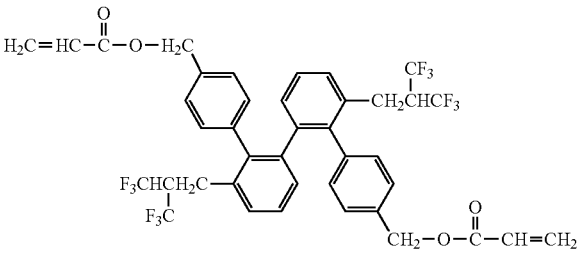

Exemplified Compound No. 81
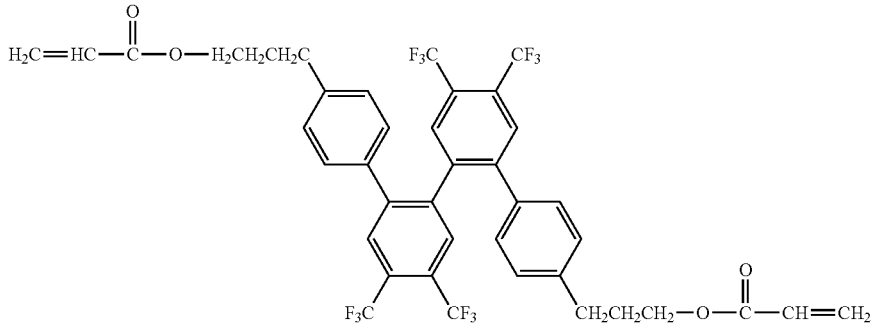
Exemplified Compound No. 82
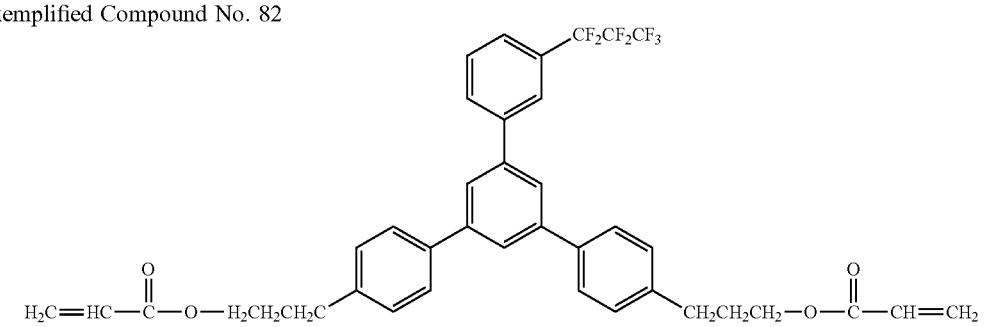
Exemplified Compound No. 83
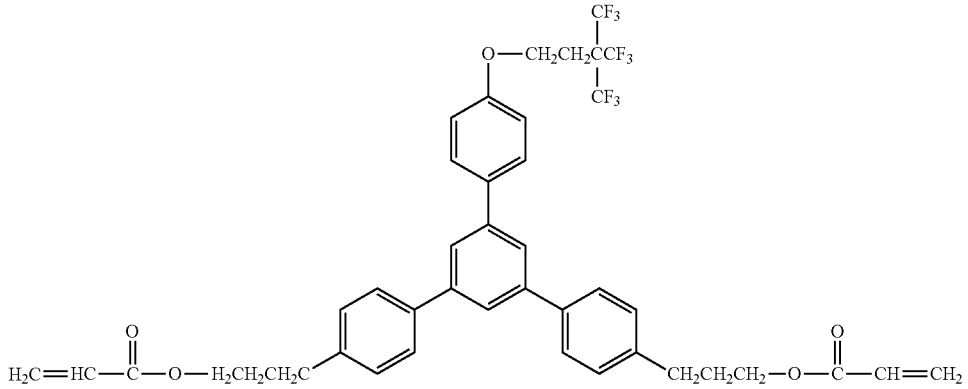
Exemplified Compound No. 84
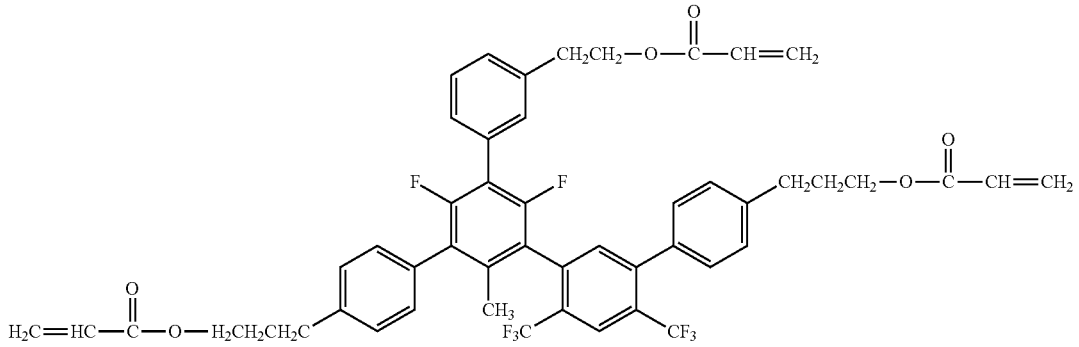

Exemplified Compound No. 85
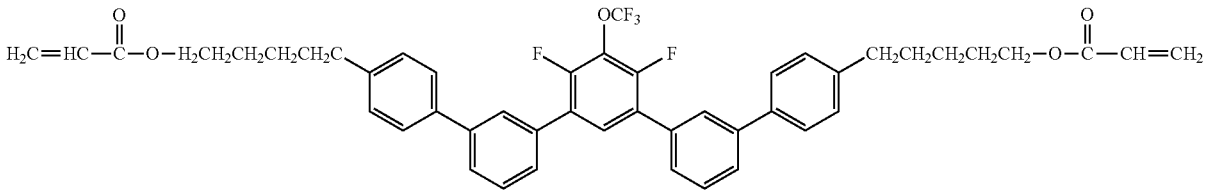
Exemplified Compound No. 86
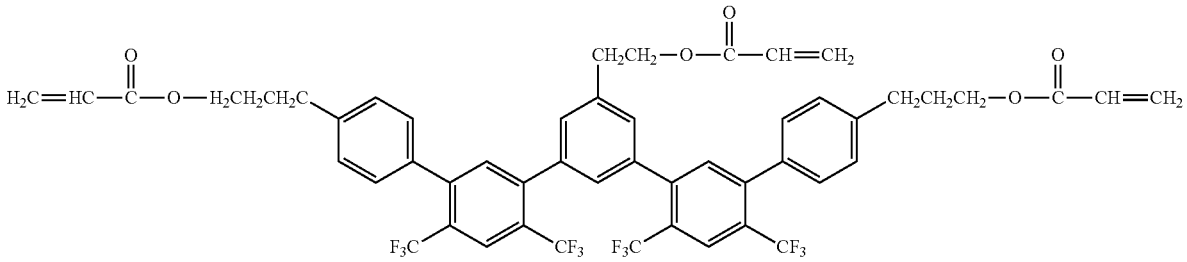
Exemplified Compound No. 87
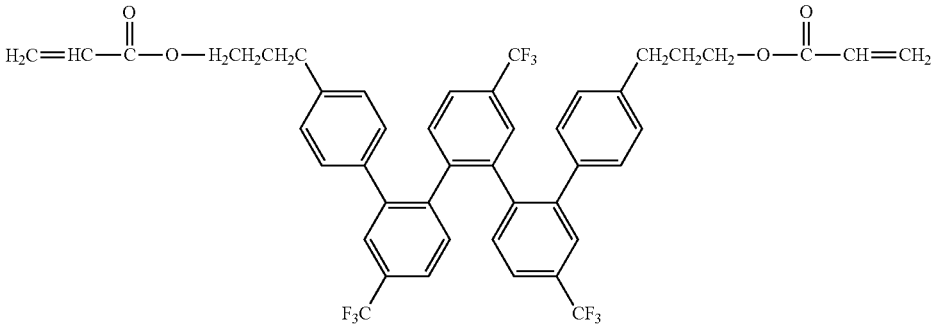
Exemplified Compound No. 88
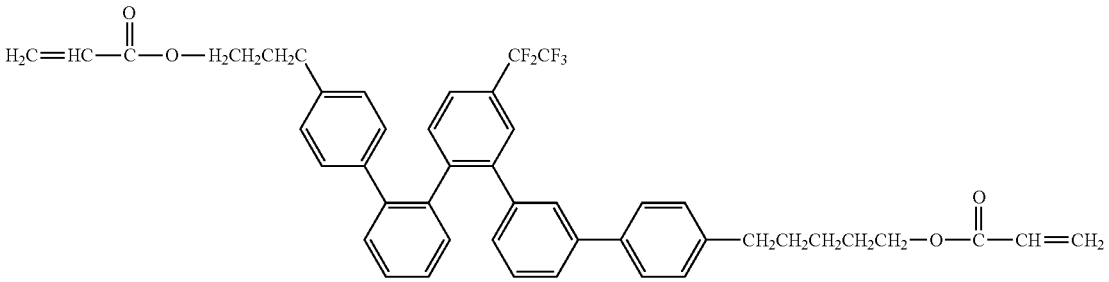

Exemplified Compound No. 89
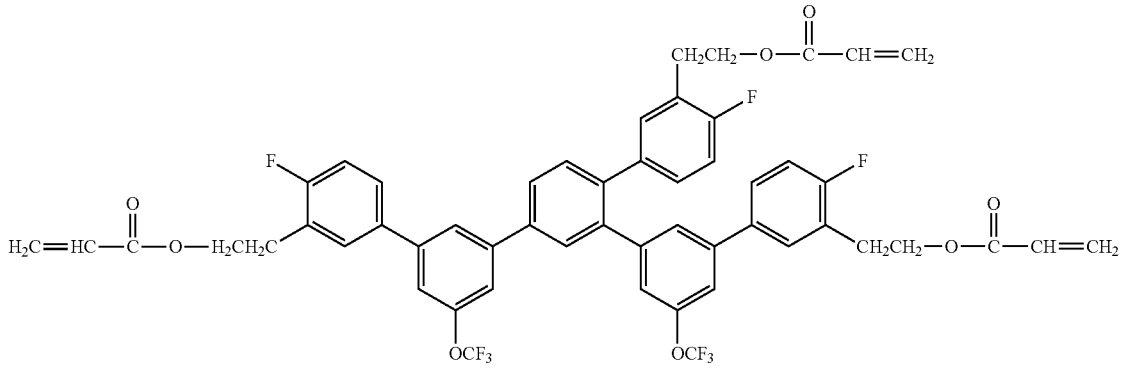
Exemplified Compound No. 90
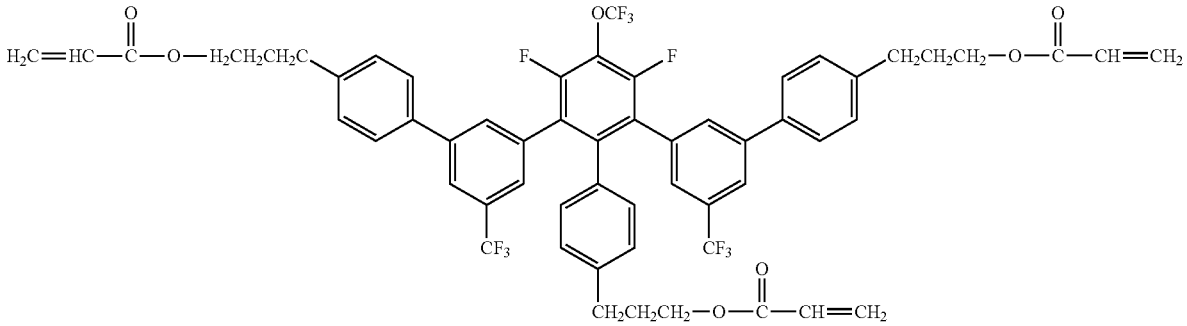
Exemplified Compound No. 91
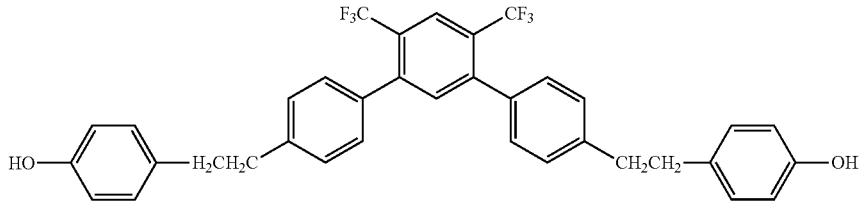
Exemplified Compound No. 92
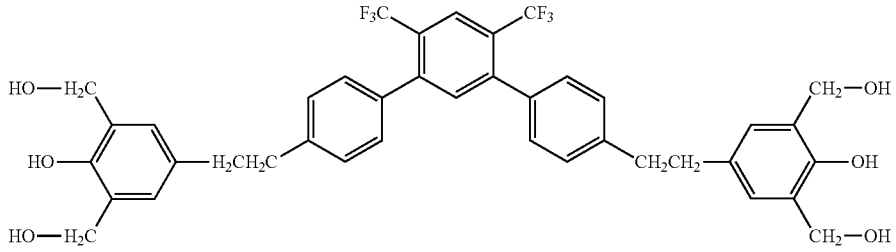

Exemplified Compound No. 93
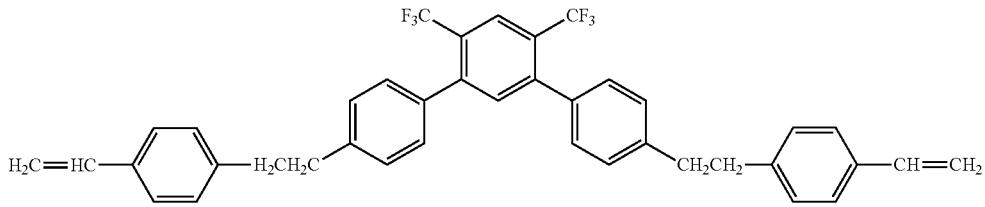
Exemplified Compound No. 94
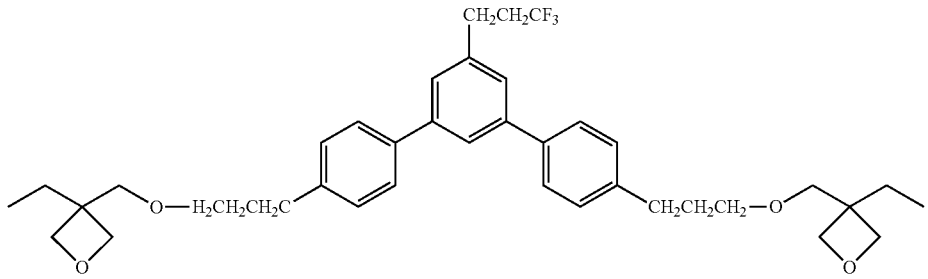
Exemplified Compound No. 95
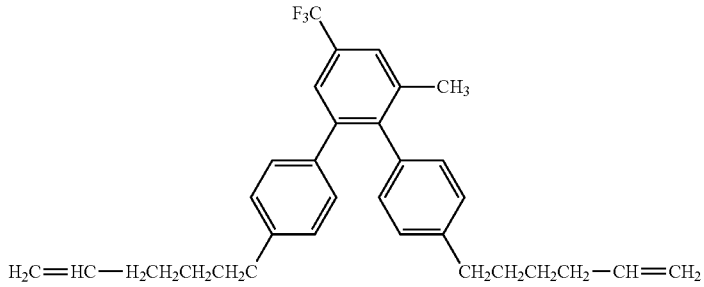
Synthesis Example
A typical synthesis example of the compound represented by the general formula (1) is shown below. Exemplified Compound No. 46 was synthesized by a reaction represented by the following reaction formula (1).
Reaction Formula (1)
Reaction formula (1)
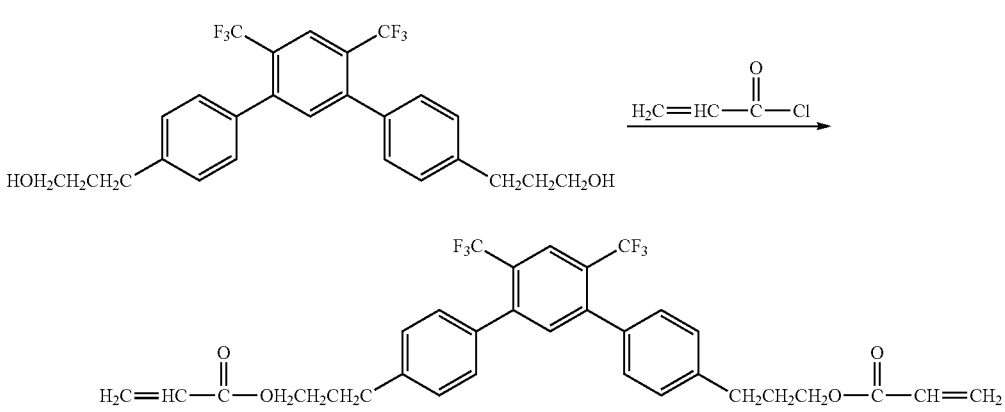

10 Parts of a dihydroxy compound represented in the formula, 80 parts of tetrahydrofuran, and 10.5 parts of triethylamine were loaded into a three-necked flask, and the mixture was dissolved. The mixture was cooled with ice water, and then 5.63 parts of acryloyl chloride was slowly dropped under cooling at 5° C. or less while attention was paid to an increase in temperature of the mixture. After the completion of the dropping, the mixture was stirred for 1 hour in a state of being cooled. Subsequently, the temperature of the reaction mixture was gradually increased until an internal temperature became room temperature, followed by continuous stirring overnight.

After the completion of the reaction, 160 parts of a 5% aqueous solution of sodium hydroxide was added to the reaction mixture. 180 Parts of ethyl acetate was loaded into the mixture, and an organic layer was extracted by liquid separation. Thus, a product was extracted. An extraction operation was further repeated three times by using 180 parts of ethyl acetate each time. The resultant organic layer was washed with pure water and a salt solution until the pH of an aqueous layer became around 7. The resultant organic layer was dehydrated with anhydrous magnesium sulfate. After that, magnesium sulfate was removed by filtration, and then the organic layer was concentrated to provide a crude product.

Impurities were removed from the resultant crude product by silica gel column chromatography, and a fraction containing a target product was collected. The solvent was removed from the resultant mixed liquid. Thus, Exemplified Compound No. 46 was obtained in a yield of 62.1%.

As described above, the synthesis example of such compound that the polymerizable functional group represented by $P^1$ in the compound represented by the general formula (1) is an acryloyloxy group has been given. The compound represented by the general formula (1) may be synthesized in accordance with the synthesis example while an acryloyloxy group is replaced with a methacryloyloxy group or any other reactive functional group as required.

<Hole-Transportable Compound Having Polymerizable Functional Group>

A known hole-transportable compound having a polymerizable functional group may be used as the hole-transportable compound having the polymerizable functional group. The compound is specifically, for example, a compound in which a polymerizable functional group is bonded to a structure having hole transportability, such as a triarylamine structure, a styryl structure, or a hydrazone structure, directly or through an arbitrary structure. Examples of the polymerizable functional group include the polymerizable functional groups given as the examples of the polymerizable functional group represented by $P^1$ in the compound represented by the general formula (1). The hole-transportable compound having the polymerizable functional group may have a plurality of polymerizable functional groups, and the plurality of polymerizable functional groups may be identical to or different from each other. In addition, the surface layer of the electrophotographic photosensitive member of the present invention may be a surface layer containing one kind of hole-transportable compound having a polymerizable functional group, or may contain a plurality of kinds of such compound.

<Surface Layer>

The surface layer may be formed by: forming a coat of an application liquid for a surface layer containing the hole-transportable compound having the polymerizable functional group and the compound represented by the general formula (1); and drying and/or curing the coat.

Various fine particles may be incorporated into the surface layer from the viewpoint of its wear resistance. The fine particles may be inorganic fine particles or may be organic fine particles. Particles containing alumina, silica, zinc oxide, tin oxide, titanium oxide, or the like are used as the inorganic fine particles. Various organic resin fine particles may be used as the organic fine particles. An organic resin serving as a material for the organic resin fine particles is, for example, a polyolefin resin, a polytetrafluoroethylene resin, a polystyrene resin, a polyacrylate resin, a polymethacrylate resin, a polyamide resin, a polyester resin, or a polyurethane resin.

As a solvent to be used for the application liquid for a surface layer, there may be used, for example, an alcohol-based solvent, a sulfoxide-based solvent, a ketone-based solvent, an ether-based solvent, an ester-based solvent, an aliphatic halogenated hydrocarbon-based solvent, an aliphatic hydrocarbon-based solvent, or an aromatic hydrocarbon-based solvent.

A method of curing the coat of the application liquid for a surface layer is, for example, a method involving polymerizing the compounds with heat, a light beam, such as UV light, or a radiation, such as an electron beam. When the polymerizable functional group of the hole-transportable compound having the polymerizable functional group and/or the polymerizable functional group $P^1$ of the compound represented by the general formula (1) is a radically polymerizable chain polymerizable functional group, polymerization with UV light or an electron beam out of the foregoing is preferred, and polymerization with an electron beam is more preferred.

A case in which a plurality of hole-transportable compounds each having a polymerizable functional group and a plurality of compounds each represented by the general formula (1) are polymerized is preferred because a three-dimensional network structure is formed in the resultant polymer and hence the wear resistance is improved. In addition, the polymerization reaction is performed in a short time and efficiently, and hence productivity is also improved. An accelerator to be used when the coat is irradiated with an electron beam is, for example, a scanning-, electrocurtain-, broad beam-, pulse-, or laminar-type accelerator.

When the electron beam is used, the acceleration voltage of the electron beam is preferably 150 kV or less from the following viewpoint: the deterioration of the material due to the electron beam can be suppressed without the impairment of polymerization efficiency. In addition, an electron beam absorbed dose on the surface of the coat of the application liquid for a surface layer is preferably 5 kGy or more and 50 kGy or less, more preferably 1 kGy or more and 10 kGy or less.

In addition, when the hole-transportable compound having a polymerizable functional group and the compound represented by the general formula (1) are polymerized with the electron beam, the following is preferred for the purpose of the suppression of the inhibitory action of oxygen on the polymerization: after having been irradiated with the electron beam in an inert gas atmosphere, the substance is heated in the inert gas atmosphere. Examples of the inert gas include nitrogen, argon, and helium.

When the surface layer is a protective layer, the thickness of the surface layer is preferably 0.1 μm or more and 15 μm or less. In addition, when the surface layer is a hole-transporting layer, the thickness is preferably 5 μm or more and 40 μm or less. Further, when the surface layer is a single-layer photosensitive layer, the thickness is preferably 5 μm or more and 40 μm or less.

The mass ratio of the compound represented by the general formula (1) with respect to the total mass of the hole-transportable compound having the polymerizable functional group and the compound represented by the general formula (1) in the surface layer is preferably from 5% by mass to 70% by mass. The compound represented by the general formula (1) does not have hole transportability. Accordingly, when the mass ratio of the compound represented by the general formula (1) is more than 70% by mass, the surface layer cannot secure required hole transportability. Meanwhile, when the mass ratio of the compound represented by the general formula (1) in the surface layer is less than 5% by mass, it becomes difficult to obtain the effects of the present invention. In addition, the mass ratio of the compound represented by the general formula (1) with respect to the total mass of the hole-transportable compound having the polymerizable functional group and the compound represented by the general formula (1) in the surface layer is more preferably from 10% by mass to 50% by mass.

<Electrophotographic Photosensitive Member>

Next, the entire construction of an electrophotographic photosensitive member of the present invention is described.

A preferred construction of the electrophotographic photosensitive member of the present invention is a construction in which a charge-generating layer and a hole-transporting layer are laminated in the stated order on a support. As required, an electroconductive layer or an undercoat layer may be formed between the charge-generating layer and the support, and a protective layer may be formed on the hole-transporting layer. In the present invention, the charge-generating layer and the hole-transporting layer are collectively referred to as "photosensitive layer".

The copolymer of the hole-transportable compound having the polymerizable functional group and the compound represented by the general formula (1) is incorporated into the surface layer of the electrophotographic photosensitive member of the present invention. The term "surface layer" as used in the present invention refers to the protective layer when the protective layer is formed in the electrophotographic photosensitive member, and refers to the hole-transporting layer when the protective layer is not formed. In addition, the photosensitive layer may be formed of a single-layer photosensitive layer containing a charge-generating substance and the hole-transporting substance.

<Support>

The support to be used in the present invention is an electroconductive support formed of a material having electroconductivity. Examples of the material for the support include: metals and alloys, such as iron, copper, gold, silver, aluminum, zinc, titanium, lead, nickel, tin, antimony, indium, chromium, an aluminum alloy, and stainless steel. In addition, there may be used a support made of a metal or a support made of a resin having a coat formed by depositing aluminum, an aluminum alloy, an indium oxide-tin oxide alloy, or the like through vacuum evaporation. In addition, there may also be used a support obtained by impregnating a plastic or paper with electroconductive particles, such as carbon black, tin oxide particles, titanium oxide particles, or silver particles, or a support containing an electroconductive resin. The shape of the support is, for example, a cylinder shape, a belt shape, a sheet shape, or a plate shape, and is most generally a cylinder shape.

The surface of the support may be subjected to a cutting treatment, a surface roughening treatment, an alumite treatment, or the like from the viewpoints of, for example, the suppression of an interference fringe due to the scattering of laser light, the alleviation of a defect in the surface of the support, and an improvement in electroconductivity of the support.

An electroconductive layer may be formed between the support and the undercoat layer, the charge-generating layer, or the single-layer photosensitive layer to be described later for the purpose of the suppression of an interference fringe due to the scattering of laser or the like, resistance control, or the covering of a flaw of the support.

The electroconductive layer may be formed by: applying an application liquid for an electroconductive layer obtained by subjecting carbon black, an electroconductive pigment, a resistance-regulating pigment, or the like to a dispersion treatment together with a binder resin; and drying the resultant coat. A compound that undergoes curing polymerization through heating, UV irradiation, radiation irradiation, or the like may be added to the application liquid for an electroconductive layer. The surface of the electroconductive layer obtained by dispersing the electroconductive pigment or the resistance-regulating pigment tends to be roughened.

The thickness of the electroconductive layer is preferably 0.1 μm or more and 50 μm or less, more preferably 0.5 μm or more and 40 μm or less, still more preferably 1 μm or more and 30 μm or less.

Examples of the binder resin to be used for the electroconductive layer include: a polymer and a copolymer of a vinyl compound, such as styrene, vinyl acetate, vinyl chloride, an acrylic acid ester, a methacrylic acid ester, vinylidene fluoride, or trifluoroethylene; and a polyvinyl alcohol resin, a polyvinyl acetal resin, a polycarbonate resin, a polyester resin, a polysulfone resin, a polyphenylene oxide resin, a polyurethane resin, a cellulose resin, a phenol resin, a melamine resin, a silicon resin, an epoxy resin, and an isocyanate resin.

Examples of the electroconductive pigment and the resistance-regulating pigment include particles of a metal (alloy), such as aluminum, zinc, copper, chromium, nickel, silver, or stainless steel, and plastic particles each having the metal deposited on its surface through evaporation. In addition, there may be used particles of a metal oxide, such as zinc oxide, titanium oxide, tin oxide, antimony oxide, indium oxide, bismuth oxide, tin-doped indium oxide, or antimony- or tantalum-doped tin oxide. Those pigments may be used alone or in combination thereof.

The undercoat layer (intermediate layer) may be formed between the support or the electroconductive layer and the charge-generating layer or the single-layer photosensitive layer for the purposes of, for example, an improvement in adhesiveness of the charge-generating layer, an improvement in property by which a hole is injected from the support, and the protection of the charge-generating layer from an electrical breakdown.

The undercoat layer may be formed by: applying an application liquid for an undercoat layer obtained by dissolving a binder resin in a solvent; and drying the resultant coat.

Examples of the binder resin to be used for the undercoat layer include a polyvinyl alcohol resin, poly-N-vinylimidazole, a polyethylene oxide resin, ethyl cellulose, an ethylene-acrylic acid copolymer, casein, a polyamide resin, an N-methoxymethylated 6-nylon resin, a copolymerized nylon resin, a phenol resin, a polyurethane resin, an epoxy resin, an acrylic resin, a melamine resin, and a polyester resin.

Metal oxide particles may be further incorporated into the undercoat layer. The metal oxide particles are, for example, particles containing titanium oxide, zinc oxide, tin oxide, zirconium oxide, or aluminum oxide. In addition, the metal oxide particles may be metal oxide particles each having a surface treated with a surface treatment agent, such as a silane coupling agent.

The thickness of the undercoat layer is preferably 0.05 μm or more and 30 μm or less, more preferably 1 μm or more and 25 μm or less. Organic resin fine particles or a leveling agent may be further incorporated into the undercoat layer.

Next, the charge-generating layer is described. The charge-generating layer may be formed by: applying an application liquid for a charge-generating layer obtained by subjecting a charge-generating substance to a dispersion treatment together with a binder resin and a solvent to form a coat; and drying the resultant coat. Alternatively, the charge-generating layer may be a deposited film of the charge-generating substance.

Examples of the charge-generating substance to be used for the charge-generating layer include azo pigments, phthalocyanine pigments, indigo pigments, perylene pigments, polycyclic quinone pigments, squarylium dyes, pyrylium salts, thiapyrylium salts, triphenylmethane dyes, quinacridone pigments, azulenium salt pigments, cyanine dyestuffs, anthanthrone pigments, pyranthrone pigments, xanthene dyes, quinone imine dyes, and styryl dyes. Those charge-generating substances may be used alone or in combination thereof. Of those charge-generating substances, from the viewpoint of sensitivity, phthalocyanine pigments or azo pigments are preferred, and phthalocyanine pigments are particularly more preferred.

Of the phthalocyanine pigments, in particular, oxytitanium phthalocyanines, chlorogallium phthalocyanines, or hydroxygallium phthalocyanines exhibit excellent charge generation efficiency. Further, of the hydroxygallium phthalocyanines, a hydroxygallium phthalocyanine crystal of a crystal form having peaks at Bragg angles 2θ in CuKα characteristic X-ray diffraction of 7.4°±0.3° and 28.2°±0.3° is more preferred from the viewpoint of sensitivity.

Examples of the binder resin to be used for the charge-generating layer include: polymers of vinyl compounds, such as styrene, vinyl acetate, vinyl chloride, an acrylic acid ester, a methacrylic acid ester, vinylidene fluoride, and trifluoroethylene; and a polyvinyl alcohol resin, a polyvinyl acetal resin, a polycarbonate resin, a polyester resin, a polysulfone resin, a polyphenylene oxide resin, a polyurethane resin, a cellulose resin, a phenol resin, a melamine resin, a silicon resin, and an epoxy resin.

The mass ratio between the charge-generating substance and the binder resin preferably falls within the range of from 1:0.3 to 1:4.

The thickness of the charge-generating layer is preferably 0.05 μm or more and 1 μm or less, more preferably 0.1 μm or more and 0.5 μm or less.

Next, the hole-transporting layer is described. When the hole-transporting layer is the surface layer, the hole-transporting layer contains the copolymer of the hole-transporting substance having the polymerizable functional group and the compound represented by the general formula (1). When the single-layer photosensitive layer is the surface layer, the single-layer photosensitive layer contains the copolymer of the hole-transporting substance having the polymerizable functional group and the compound represented by the general formula (1), and the charge-generating substance in the charge-generating layer.

Meanwhile, when the protective layer is formed on the hole-transporting layer, the hole-transporting layer may be formed by: forming a coat of an application liquid for a hole-transporting layer obtained by mixing the hole-transporting substance and a binder resin in a solvent; and drying the coat. Now, the hole-transporting substance and the binder resin to be used in the hole-transporting layer are described.

Examples of the hole-transporting substance include a carbazole compound, a hydrazone compound, an N,N-dialkylaniline compound, a diphenylamine compound, a triphenylamine compound, a triphenylmethane compound, a pyrazoline compound, a styryl compound, and a stilbene compound.

Examples of the binder resin include an acrylic acid ester, a methacrylic acid ester, a polyvinyl alcohol resin, a polyvinyl acetal resin, a polycarbonate resin, and a polyester resin. In addition, there may be used a curable resin, such as a curable phenol resin, a curable urethane resin, a curable melamine resin, a curable epoxy resin, a curable acrylic resin, or a curable methacrylic resin.

Examples of the solvent to be used for the application liquid for a hole-transporting layer include an alcohol-based solvent, a sulfoxide-based solvent, a ketone-based solvent, an ether-based solvent, an ester-based solvent, an aliphatic halogenated hydrocarbon-based solvent, and an aromatic hydrocarbon-based solvent.

The thickness of the hole-transporting layer is preferably 1 μm or more and 100 μm or less, more preferably 3 μm or more and 50 μm or less, still more preferably 5 μm or more and 40 μm or less.

When the protective layer is formed on the single-layer photosensitive layer, the single-layer photosensitive layer may be formed by: preparing an application liquid for a photosensitive layer containing a charge-generating substance, a charge-transporting substance, a resin, and a solvent; forming a coat of the liquid; and drying the coat. Examples of the charge-generating substance, the charge-transporting substance, and the resin are the same as the examples of the materials in the charge-generating layer and the hole-transporting layer.

The thickness of the single-layer photosensitive layer is preferably 1 μm or more and 100 μm or less, more preferably 3 μm or more and 50 μm or less, still more preferably 5 μm or more and 40 μm or less.

Various additives may be added to the respective layers of the electrophotographic photosensitive member of the present invention. Specific examples thereof include an organic pigment, an organic dyestuff, a coat surface adjustor, an electron transport agent, an oil, a wax, an antioxidant, a light absorber, a polymerization initiator, a radical deactivator, organic resin fine particles, and inorganic particles.

The surface of each layer of the electrophotographic photosensitive member may be subjected to surface processing with, for example, an abrasive sheet, a shape transfer mold member, glass beads, or zirconia beads. In addition, unevenness may be formed in the surface with a constituent material for the application liquid.

Examples of the solvent to be used for the application liquid for each of the layers include an alcohol-based solvent, a sulfoxide-based solvent, a ketone-based solvent, an ether-based solvent, an ester-based solvent, an aliphatic halogenated hydrocarbon-based solvent, an aliphatic hydrocarbon-based solvent, an aromatic halogenated hydrocarbon-based solvent, and an aromatic hydrocarbon-based solvent.

In the application of the application liquid for each of the layers, there may be used any known application method, such as a dip coating method, a spray coating method, a circular amount-regulating type (ring) coating method, a spin coating method, a roller coating method, a Mayer bar coating method, or a blade coating method.

Next, a process cartridge including the electrophotographic photosensitive member of the present invention and an image forming process are described.

FIG. 1 is an illustration of an example of the construction of the process cartridge of the present invention. In FIG. 1, an electrophotographic photosensitive member 1 having a cylindrical shape is rotationally driven in an arrow direction at a predetermined peripheral speed. The peripheral surface of the electrophotographic photosensitive member 1 to be rotationally driven is uniformly charged to a predetermined positive or negative potential by a charging unit 2, such as a charging roller. Next, the charged peripheral surface of the electrophotographic photosensitive member 1 receives exposure light (image exposure light) 3 output from an exposing unit (not shown), such as slit exposure or laser beam scanning exposure. Thus, electrostatic latent images corresponding to a target image are sequentially formed on the peripheral surface of the electrophotographic photosensitive member 1. Any one of a voltage obtained by superimposing an AC component on a DC component and a voltage consisting of the DC component may be used as a voltage to be applied to the charging unit 2.

The electrostatic latent images formed on the peripheral surface of the electrophotographic photosensitive member 1 are developed with toner in the developer of a developing unit 4 to be turned into toner images. Next, the toner images formed and borne on the peripheral surface of the electrophotographic photosensitive member 1 are sequentially transferred onto a transfer material 6, such as paper or an intermediate transfer member 10, by a transfer bias from a transferring unit 5, such as a transfer roller. The transfer material 6 is fed in synchronization with the rotation of the electrophotographic photosensitive member 1.

The surface of the electrophotographic photosensitive member 1 after the transfer of the toner images is subjected to an electricity-eliminating treatment with pre-exposure light 7 from a pre-exposing unit (not shown), and is then cleaned through the removal of transfer residual toner by a cleaning unit 8. Thus, the electrophotographic photosensitive member 1 is repeatedly used in image formation. The pre-exposing unit may be operated before or after the cleaning step, and the pre-exposing unit is not necessarily needed.

The electrophotographic photosensitive member 1 may be mounted onto an electrophotographic apparatus, such as a copying machine or a laser beam printer. In addition, a process cartridge 9 having the following feature may be provided: the process cartridge integrally supports the electrophotographic photosensitive member 1, and at least one unit selected from the group consisting of the charging unit 2, the developing unit 4, and the cleaning unit 8, and is removably mounted onto the main body of the electrophotographic apparatus. Further, the process cartridge 9 formed by storing two or more of the constituent components, such as the electrophotographic photosensitive member 1, the charging unit 2, the developing unit 4, and the cleaning unit 8, in a container, and integrally supporting the components may be formed so as to be removably mounted onto the main body of the electrophotographic apparatus.

Next, an electrophotographic apparatus including the electrophotographic photosensitive member of the present invention is described.

Figure 2:
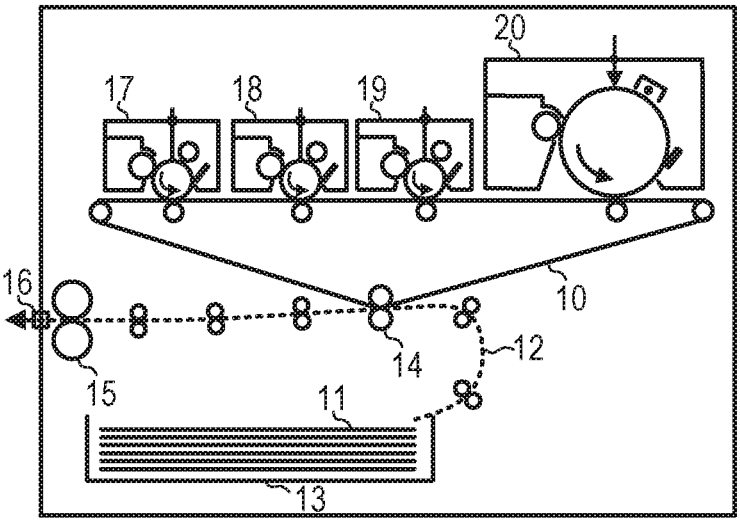
FIG. 2 is a schematic view for illustrating an example of an electrophotographic apparatus including an electrophotographic photosensitive member.

FIG. 2 is an illustration of an example of the construction of the electrophotographic apparatus of the present invention. A process cartridge 17 for a yellow color, a process cartridge 18 for a magenta color, a process cartridge 19 for a cyan color, and a process cartridge 20 for a black color corresponding to the respective colors are arranged side by side along an intermediate transfer member 10. As illustrated in FIG. 2, the diameter and constituent material of the electrophotographic photosensitive member, a developer, a charging system, and any other unit do not necessarily need to be standardized for the respective colors. For example, in the electrophotographic apparatus of FIG. 2, the diameter of the electrophotographic photosensitive member of the process cartridge 20 for the black color is larger than the diameters of the electrophotographic photosensitive members of the process cartridges 17, 18, and 19 for the yellow, magenta, and cyan colors. In addition, while charging systems for the yellow, magenta, and cyan colors are each a system involving applying a voltage obtained by superimposing an AC component on a DC component, a system involving using corona discharge is adopted for the black color.

When an image forming operation starts, the toner images of the respective colors are sequentially superimposed on the intermediate transfer member 10 according to the image forming process. In tandem with the foregoing, transfer paper 11 is sent from a sheet feeding tray 13 by a sheet feeding path 12, and is then fed to a secondary transferring unit 14 in timing with the rotation operation of the intermediate transfer member 10. The toner images on the intermediate transfer member 10 are transferred onto the transfer paper 11 by a transfer bias from the secondary transferring unit 14. The toner images transferred onto the transfer paper 11 are conveyed along the sheet feeding path 12, fixed on the transfer paper 11 by a fixing unit 15, and discharged from a sheet discharging portion 16.

EXAMPLES

Now, the present invention is described in more detail by way of specific Examples. The term "part(s)" in Examples refers to "part(s) by mass". In addition, an electrophotographic photosensitive member is hereinafter sometimes simply referred to as "photosensitive member".

<Production of Electrophotographic Photosensitive Member>

Example 1

A cylindrical aluminum cylinder having an outer diameter of 30.0 mm, a length of 357.5 mm, and a wall thickness of 0.7 mm was used as a support (electroconductive support).

Next, 10 parts of zinc oxide particles (specific surface area: 19 $m^2/g$, powder resistivity: $4.7\times10^6$ Ω·cm) were mixed with 50 parts of toluene by stirring, and 0.08 part of N-(2-aminoethyl)-3-aminopropylmethyldimethoxysilane (product name: KBM-602, manufactured by Shin-Etsu Chemical Co., Ltd.) was added as a silane coupling agent to the mixture, followed by stirring for 6 hours. After that, toluene was evaporated under reduced pressure, and the residue was dried by heating at 130° C. for 6 hours to provide surface-treated zinc oxide particles.

Next, 15 parts of a polyvinyl butyral resin (weight-average molecular weight: 40,000, product name: BM-1, manufactured by Sekisui Chemical Co., Ltd.) and 15 parts of a blocked isocyanate (product name: DURANATE TPA-B80E, manufactured by Asahi Kasei Chemicals Corporation) were dissolved in a mixed solution of 73.5 parts of methyl ethyl ketone and 73.5 parts of 1-butanol. 80.8 Parts of the surface-treated zinc oxide particles and 0.8 part of 2,3,4-trihydroxybenzophenone (manufactured by Wako Pure Chemical Industries, Ltd.) were added to the solution, and the mixture was dispersed with a sand mill apparatus using glass beads each having a diameter of 0.8 mm under an atmosphere at 23±3° C. for 3 hours. After the dispersion, 0.01 part of a silicone oil (product name: SH28PA, manufactured by Dow Corning Toray Co., Ltd.) and 5.6 parts of crosslinked polymethyl methacrylate (PMMA) particles (average primary particle diameter: 2.5 μm, product name: TECHPOLYMER SSX-102, manufactured by Sekisui Plastics Co., Ltd.) were added to the resultant, and the mixture was stirred to prepare an application liquid for an undercoat layer.

The application liquid for an undercoat layer was applied onto the support by dipping to form a coat, and the resultant coat was dried for 40 minutes at 160° C. to form an undercoat layer having a thickness of 18 μm.

Next, a hydroxygallium phthalocyanine crystal (charge-generating substance) of a crystal form having peaks at Bragg angles 2θ±0.2° in CuKα characteristic X-ray diffraction of 7.4° and 28.2° was prepared. 2 Parts of the hydroxygallium phthalocyanine crystal, 0.02 part of a calixarene compound represented by the following structural formula (A), 1 part of polyvinyl butyral (product name: S-LEC BX-1, manufactured by Sekisui Chemical Co., Ltd.), and 60 parts of cyclohexanone were loaded into a sand mill using glass beads each having a diameter of 1 mm, followed by a dispersion treatment for 4 hours. After that, 70 parts of ethyl acetate was added to the resultant to prepare an application liquid for a charge-generating layer. The application liquid for a charge-generating layer was applied onto the undercoat layer by dipping, and the resultant coat was dried for 15 minutes at 90° C. to form a charge-generating layer having a thickness of 0.17 μm.

(A)

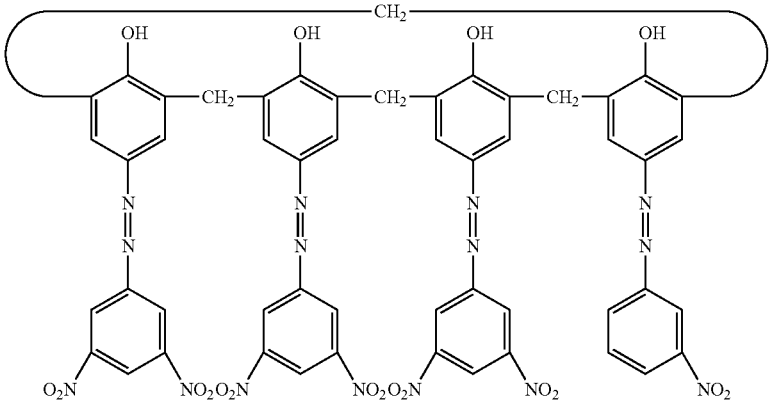

Next, 6 parts of a compound represented by the following structural formula (B), 3 parts of a compound represented by the following structural formula (C), 1 part of a compound represented by the following structural formula (D), and 10 parts of a bisphenol Z-type polycarbonate resin (product name: Iupilon Z400, manufactured by Mitsubishi Engineering-Plastics Corporation) were dissolved in a mixed solvent of 60 parts of monochlorobenzene and 20 parts of dimethoxymethane to prepare an application liquid for a hole-transporting layer. The application liquid for a hole-transporting layer was applied onto the charge-generating layer by dipping, and the resultant coat was dried for 50 minutes at 100° C. to form a first hole-transporting layer having a thickness of 18 μm.

(B)

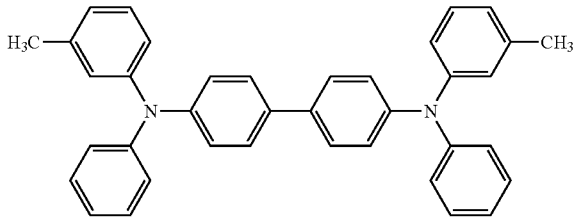

(C)

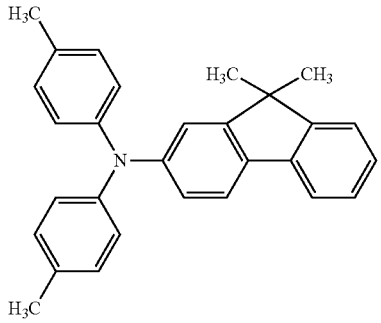

-continued (D)

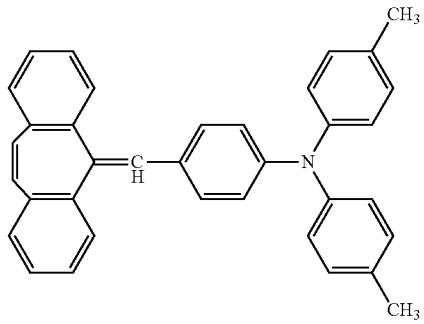

Next, an application liquid for a protective layer was prepared by dissolving 1.8 parts of Exemplified Compound No. 1 and 4.2 parts of a hole-transporting substance represented by the following formula (E) in 7 parts of 1-propanol and 7 parts of ZEORORA-H (manufactured by Zeon Corporation) used as solvents.

(E)

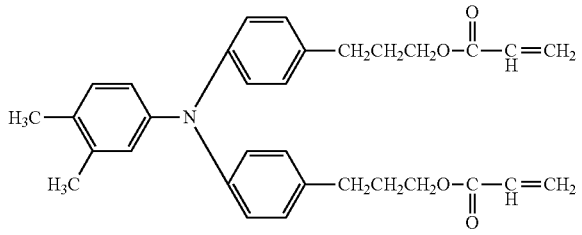

The application liquid for a protective layer was applied onto the hole-transporting layer by dipping, and the resultant coat was dried for 10 minutes at 50° C., followed by a polymerization curing treatment through electron beam irradiation and heating under the following conditions.

In an atmosphere having an oxygen concentration of 100 ppm or less, the electron beam irradiation was performed with an electron beam irradiation apparatus under the conditions of an irradiation distance of 30 mm, an acceleration voltage of 70 kV, a beam current of 7 mA, and an irradiation time of 2.4 seconds while the aluminum cylinder was rotated at a speed of 300 rpm. Immediately after the electron beam irradiation, the temperature of the protective layer coat surface was caused to reach 130° C. over 20 seconds under the condition of an oxygen concentration of 100 ppm or less with an induction heating apparatus.

Next, the aluminum cylinder was brought out to an air atmosphere, and was further heated for 10 minutes at 100° C. Thus, a protective layer having a thickness of 3.5 μm was formed. An example photosensitive member 1 was produced as described above.

Example 2

An example photosensitive member 2 was produced in the same manner as in the example photosensitive member 1 except that Exemplified Compound No. 8 was used instead of Exemplified Compound No. 1 used in Example 1 above.

Example 3

An example photosensitive member 3 was produced in the same manner as in the example photosensitive member 1 except that Exemplified Compound No. 9 was used instead of Exemplified Compound No. 1 used in Example 1 above.

Example 4

The process up to the formation of the hole-transporting layer was performed in the same manner as in the example photosensitive member 1 except that a protective layer was formed as described below.

1.5 Parts of a fluorine atom-containing resin (product name: GF-400, manufactured by Toagosei Co., Ltd.) was dissolved in a mixed solvent of 45 parts of 1-propanol and 45 parts of ZEORORA-H. After that, 30 parts of ethylene fluoride resin powder (product name: RUBURON L-2, manufactured by Daikin Industries, Ltd.) was added to the solution, and the mixture was dispersed with a high-pressure disperser (product name: Microfluidizer M-110EH, manufactured by Microfluidics in the U.S.) to provide an ethylene fluoride resin dispersion.

1.2 Parts of Exemplified Compound No. 13, 2.8 parts of the hole-transporting substance represented by the formula (E), 8 parts of the ethylene fluoride resin dispersion, 4 parts of 1-propanol, and 4 parts of ZEORORA-H were stirred and uniformly dispersed to prepare an application liquid for a protective layer. A protective layer having a thickness of 3.5 μm was formed in the same manner as in Example 1 through the application of the liquid onto the hole-transporting layer by dipping. An example photosensitive member 4 was produced as described above.

Example 5

An example photosensitive member 5 was produced in the same manner as in the example photosensitive member 4 except that Exemplified Compound No. 14 was used instead of Exemplified Compound No. 13 used in Example 4 above.

Example 6

An example photosensitive member 6 was produced in the same manner as in the example photosensitive member 4 except that Exemplified Compound No. 29 was used instead of Exemplified Compound No. 13 used in Example 4 above.

Example 7

An example photosensitive member 7 was produced in the same manner as in the example photosensitive member 4 except that: 1.2 parts of Exemplified Compound No. 35 was used instead of Exemplified Compound No. 13 used in Example 4 above; and 2.8 parts of a hole-transporting substance represented by the following formula (F) was used instead of the hole-transporting substance represented by the formula (E).

(F)

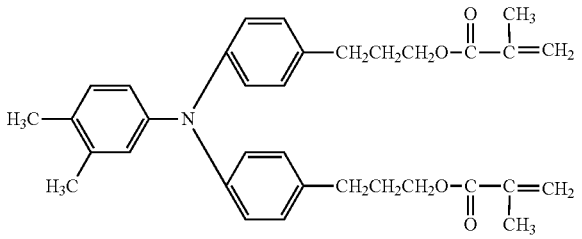

Example 8

An example photosensitive member 8 was produced in the same manner as in the example photosensitive member 4 except that: 0.8 part of Exemplified Compound No. 46 was used instead of Exemplified Compound No. 13 used in Example 4 above; and 3.2 parts of the hole-transporting substance represented by the formula (E) was used.

Example 9

An example photosensitive member 9 was produced in the same manner as in the example photosensitive member 4 except that: 1.2 parts of Exemplified Compound No. 46 was used instead of Exemplified Compound No. 13 used in Example 4 above; and 2.8 parts of the hole-transporting substance represented by the formula (E) was used.

Example 10

An example photosensitive member 10 was produced in the same manner as in the example photosensitive member 4 except that: 1.6 parts of Exemplified Compound No. 46 was used instead of Exemplified Compound No. 13 used in Example 4 above; and 2.4 parts of the hole-transporting substance represented by the formula (E) was used.

Example 11

The same aluminum cylinder as that used in the example photosensitive member 1 was used as a support.

Next, 60 parts of $TiO_2$ particles covered with oxygen-deficient $SnO_2$ serving as electroconductive particles (powder resistivity: 100 Ω·cm, coverage with $SnO_2$ (mass ratio): 35%), 36.5 parts of a phenol resin serving as a binder resin (resin solid content: 60%, product name: PLYOPHEN J-325, manufactured by DIC Corporation (formerly Dainippon Ink and Chemicals, Incorporated)), and 20 parts of methoxypropanol serving as a solvent were dispersed with a horizontal sand mill disperser using glass beads each having a diameter of 1 mm.

The glass beads were removed from the dispersion with a mesh. After that, 1.6 parts of silicone resin particles serving as a surface roughness-imparting material (average particle diameter: 2 μm, product name: TOSPEARL 120, manufactured by Momentive Performance Materials Japan LLC (formerly GE Toshiba Silicone Co., Ltd.)) and 0.008 part of a silicone oil serving as a leveling agent (product name: SH28PA, manufactured by Dow Corning Toray Silicone Co., Ltd.) were added to the dispersion, and the mixture was stirred to prepare an application liquid for an electroconductive layer. The average particle diameter of the $TiO_2$ particles covered with oxygen-deficient $SnO_2$ in the application liquid for an electroconductive layer was 0.35 μm. The application liquid for an electroconductive layer was applied onto the support by dipping, and the liquid was dried and cured for 30 minutes at 140° C. to form an electroconductive layer having a thickness of 18 μm.

Next, 10 parts of a methoxymethylated 6-nylon resin (product name: TORESIN EF-30T, manufactured by Teikoku Kagaku Sangyo K.K.) was dissolved in a mixed solvent of 100 parts of methanol and 50 parts of n-butanol to prepare an application liquid for an undercoat layer. The application liquid for an undercoat layer was applied onto the electroconductive layer by dipping, and the resultant coat was dried for 30 minutes at 100° C. to form an undercoat layer having a thickness of 0.45 μm. Subsequently, a charge-generating layer and a hole-transporting layer were formed in the stated order in the same manner as in Example 1.

Next, an example photosensitive member 11 was produced by forming a protective layer having a thickness of 3.5 μm in the same manner as in Example 1.

Example 12

An example photosensitive member 12 was produced by performing the process up to the formation of the hole-transporting layer in the same manner as in Example 11, and then forming a protective layer having a thickness of 3.5 μm in the same manner as in Example 9.

Example 13

The same undercoat layer as that of Example 1 was formed on the same aluminum cylinder as that of Example 1.

Next, an oxytitanium phthalocyanine crystal (charge-generating substance) of a crystal form having a peak at a Bragg angle 2θ±0.2° in CuKα characteristic X-ray diffraction of 27.2° was prepared. 2 Parts of the oxytitanium phthalocyanine crystal, 1 part of polyvinyl butyral (product name: S-LEC BM-S, manufactured by Sekisui Chemical Co., Ltd.), and 50 parts of cyclohexanone were loaded into a sand mill using glass beads each having a diameter of 1 mm, and were subjected to a dispersion treatment for 4 hours. After that, 40 parts of ethyl acetate was added to the resultant. Thus, an application liquid for a charge-generating layer was prepared. The application liquid for a charge-generating layer was applied onto the undercoat layer by dipping, and the resultant coat was dried for 10 minutes at 80° C. to form a charge-generating layer having a thickness of 0.18 μm. The same hole-transporting layer as that of Example 1 was formed on the charge-generating layer.

Next, an application liquid for a protective layer was prepared by dissolving 1.8 parts of Exemplified Compound No. 1, 4.2 parts of the hole-transporting substance represented by the formula (E), and 0.3 part of 1-hydroxycyclohexyl phenyl ketone serving as a photopolymerization initiator in 7 parts of 1-propanol and 7 parts of ZEORORA-H (manufactured by Zeon Corporation). The liquid was applied onto the hole-transporting layer by dipping, and the coat was dried for 10 minutes at 45° C., followed by a photocuring treatment under the following conditions.

Under an atmosphere having an oxygen concentration of from 6,000 ppm to 8,000 ppm, the aluminum cylinder having the coat of the application liquid for a protective layer was rotated at a speed of 100 rpm, and was irradiated with light by using a metal halide lamp having an output of 160 W/cm$^2$ under the conditions of an irradiation distance of 100 mm, an irradiation intensity of 600 mW/cm$^2$, and an irradiation time of 2 minutes. After the photoirradiation, the resultant was subjected to a heat treatment for 30 minutes at 135° C. to form a protective layer having a thickness of 3.5 μm. Thus, an example photosensitive member 13 was produced.

Example 14

The process up to the formation of the hole-transporting layer was performed in the same manner as in Example 13. Next, 1.2 parts of Exemplified Compound No. 46, 2.8 parts of the hole-transporting substance represented by the formula (E), 8 parts of the ethylene fluoride resin dispersion, 0.3 part of 1-hydroxycyclohexyl phenyl ketone, 4 parts of 1-propanol, and 4 parts of ZEORORA-H were stirred and uniformly dispersed to prepare an application liquid for a protective layer.

The liquid was applied onto the hole-transporting layer by dipping, followed by a photocuring treatment under the same conditions as those of Example 13, to thereby form a protective layer having a thickness of 3.5 μm. Thus, an example photosensitive member 14 was produced.

Example 15

An example photosensitive member 15 was produced in the same manner as in the example photosensitive member 4 except that the polymerizable compound represented by Exemplified Compound No. 12 was used instead of Exemplified Compound No. 13 used in Example 4 above.

Example 16

An example photosensitive member 16 was produced in the same manner as in the example photosensitive member 4 except that the polymerizable compound represented by Exemplified Compound No. 32 was used instead of Exemplified Compound No. 13 used in Example 4 above.

Example 17

An example photosensitive member 17 was produced in the same manner as in the example photosensitive member 4 except that: 0.8 part of Exemplified Compound No. 63 was used instead of Exemplified Compound No. 13 used in Example 4 above; and 3.2 parts of the hole-transporting substance represented by the formula (E) was used.

Example 18

An example photosensitive member 18 was produced in the same manner as in the example photosensitive member 4 except that: 0.8 part of Exemplified Compound No. 70 was used instead of Exemplified Compound No. 13 used in Example 4 above; and 3.2 parts of the hole-transporting substance represented by the formula (E) was used.

Comparative Example 1

A comparative example photosensitive member 1 was produced in the same manner as in the example photosensitive member 4 except that Comparative Compound No. 1 below was used instead of Exemplified Compound No. 13 used in Example 4 above.

Comparative Compound No. 1

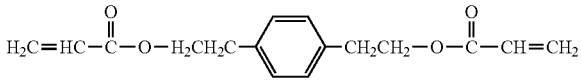

Comparative Example 2

A comparative example photosensitive member 2 was produced in the same manner as in the example photosensitive member 4 except that Comparative Compound No. 2 below was used instead of Exemplified Compound No. 13 used in Example 4 above.

Comparative Compound No. 2

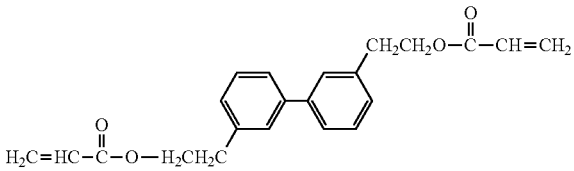

Comparative Example 3

A comparative example photosensitive member 3 was produced in the same manner as in the example photosensitive member 4 except that the polymerizable compound represented by Comparative Compound No. 3 below was used instead of Exemplified Compound No. 13 used in Example 4 above.

Comparative Compound No. 3

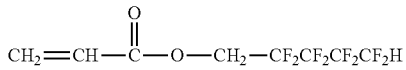

Comparative Example 4

A comparative example photosensitive member 4 was produced in the same manner as in the example photosensitive member 4 except that Comparative Compound No. 4 below was used instead of Exemplified Compound No. 13 used in Example 4 above.

Comparative Compound No. 4

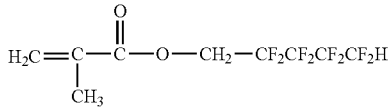

Comparative Example 5

A comparative example photosensitive member 5 was produced in the same manner as in the example photosensitive member 4 except that Comparative Compound No. 5 below described in Japanese Patent Application Laid-Open No. 2008-197632 was used instead of Exemplified Compound No. 13 used in Example 4 above.

Comparative Compound No. 5

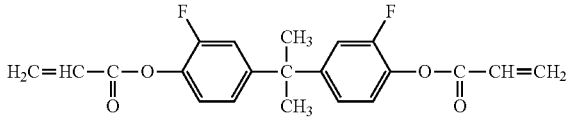

<Evaluation: Initial Sensitivity and Residual Potential>

Each of the produced example photosensitive members 1 to 18 and comparative example photosensitive members 1 to 5 was evaluated for its sensitivity and residual potential under the following conditions.

A photosensitive member testing apparatus (product name: CYNTHIA 59, manufactured by Gen-Tech, Inc.) was used. First, a condition for a charging device was set so that the surface potential of an electrophotographic photosensitive member became −700 V under an environment having a temperature of 23° C. and a humidity of 50% RH. The photosensitive member was irradiated with monochromatic light having a wavelength of 780 nm, and the quantity of the light needed for reducing the potential of −700 V to −200 V was measured and defined as sensitivity ($\mu J/cm^2$). Further, the potential of the photosensitive member when the photosensitive member was irradiated with light having a quantity of 20 ($\mu J/cm^2$) was measured and defined as a residual potential (−V).

<Evaluation: Evaluation of Image Smearing Under High-Temperature and High-Humidity Environment>

Image smearing was evaluated by using each of the produced example photosensitive members 1 to 18 and comparative example photosensitive members 1 to 5 under the following conditions.

A reconstructed machine of a copying machine available under the product name "imageRUNNER (iR) (trademark) ADVANCE C5560F" from Canon Inc. was used as an electrophotographic apparatus. Reconstructed points are as described below. The machine was reconstructed so that image exposure laser power, the quantity of a current flowing from a charging roller to the support of an electrophotographic photosensitive member (hereinafter sometimes referred to as "total current"), and a voltage to be applied to the charging roller could be regulated and measured. Further, a cassette heater was removed.

First, the electrophotographic apparatus and the electrophotographic photosensitive members were left to stand in an environment having a temperature of 30° C. and a humidity of 80% RH for 24 hours or more. After that, each of the example and comparative example electrophotographic photosensitive members was mounted onto the cartridge for a cyan color of the electrophotographic apparatus.

Next, the applied voltage was applied while being changed from −400 V to −2,000 V by 100 V, and a total current at each applied voltage was measured. Then, a graph whose axis of abscissa and axis of ordinate indicated the applied voltage and the total current, respectively was created, and the applied voltage at which a current component (hereinafter sometimes referred to as "discharge current") diverging from a first-order approximation curve in the applied voltage range of from −400 V to −800 V became 100 μA was determined. A value for the total current was set to a value at which the discharge current became 100 μA.

Next, a solid image was output on A4 size plain paper with a cyan color alone, and an image exposure light quantity was set so that the density of the image on the paper measured with a spectral densitometer (product name: X-Rite 504, manufactured by X-Rite Inc.) became 1.45±0.5.

Next, in a state of the above-mentioned density setting, an A4 size square lattice image having a line width of 0.1 mm and a line interval of 10 mm was read with a scanner and continuously output on 5,000 sheets with a cyan color alone. After the image output, the main power source of the electrophotographic apparatus was turned off and the apparatus was left to stand for 3 days. After the standing, the main power source of the electrophotographic apparatus was turned on. Immediately after that, the square lattice image was similarly output on 1 sheet, the image smearing of the output image was visually observed, and the image smearing was evaluated by the following criteria.

Evaluation ranks were as described below.

Rank 5: No anomaly is observed in the lattice image.

Rank 4: A horizontal line of the lattice image is broken but no anomaly is observed in a vertical line thereof.

Rank 3: A horizontal line of the lattice image disappears but no anomaly is observed in a vertical line thereof.

Rank 2: A horizontal line of the lattice image disappears and a vertical line thereof is broken.

Rank 1: A horizontal line of the lattice image disappears and a vertical line thereof also disappears.

In this case, a horizontal line in the lattice image refers to a line parallel to the cylinder axis direction of the photosensitive member and a vertical line therein refers to a line vertical to the cylinder axis direction of the photosensitive member.

<Evaluation: Evaluation of Image Density Unevenness at Time of Endurance Use>

Image unevenness in association with a change due to, for example, the adhesion of toner to the surface layer of a photosensitive member was evaluated by using each of the produced example photosensitive members 1 to 18 and comparative example photosensitive members 1 to 5. A copying machine available under the product name "iR ADVANCE C5560F" from Canon Inc. was used as an electrophotographic apparatus.

First, the electrophotographic apparatus and the electrophotographic photosensitive members were left to stand in an environment having a temperature of 30° C. and a humidity of 80% RH for 24 hours or more. After that, the electrophotographic photosensitive members of Examples and Comparative Examples were each mounted onto the cartridge for a cyan color of the electrophotographic apparatus. The apparatus was subjected to the following continuous sheet passing endurance use: an image having a print percentage of 5% was printed on 10,000 sheets of A4 size plain paper at such a density that a solid image density measured with a spectral densitometer X-Rite 504 (manufactured by X-Rite Inc.) became 1.45±0.5.

After the sheet passing endurance use, power supply to the copying machine was completely stopped, and the machine was halted for 15 hours. After the lapse of 15 hours, the power supply to the copying machine was started again, and a one-dot knight-jump pattern halftone image was output on A3 size plain paper with a cyan color alone. A light quantity was set so that the density of the halftone image became 0.85. The densities of the maximum image density portion and minimum image density portion of the halftone image were measured with the X-Rite 504, and an image unevenness rank was judged from a difference between the densities.

The results are shown in Table 1. In the present invention, when the density difference was less than 0.1, it was judged that the effects of the present invention were obtained.

Evaluation ranks were as described below.

Rank 5: No density difference is observed in the halftone image.

Rank 4: An insignificant density difference is observed in the halftone image.

Rank 3: A slight density difference is observed in the halftone image, though the difference is less than 0.1.

Rank 2: A density difference of 0.1 or more is observed in the halftone image.

Rank 1: A density difference of 0.2 or more is observed in the halftone image.

<Evaluation: Evaluation of Wear Amount at Time of Endurance Use>

The wear amount of a protective layer at the time of its endurance use under a low-humidity environment was evaluated by using each of the produced example photosensitive members 1 to 18 and comparative example photosensitive members 1 to 5 under the following conditions. A reconstructed machine of a copying machine "iR ADVANCE C5560F" manufactured by Canon Inc. was used as an electrophotographic apparatus. A reconstructed point is as follows: the machine was reconstructed so that image exposure laser power could be regulated.

First, the thickness of the protective layer of each of the electrophotographic photosensitive members before image output on 50,000 sheets was measured with an interference thickness meter (product name: MCPD-3700, manufactured by Otsuka Electronics Co., Ltd.).

The electrophotographic apparatus and the electrophotographic photosensitive members were left to stand in an environment having a temperature of 23° C. and a humidity of 5% RH for 24 hours or more. After that, the electrophotographic photosensitive members were each mounted onto the cartridge for a cyan color of the electrophotographic apparatus. The following intermittent sheet passing endurance output was performed: an image having a print percentage of 5% was output on 50,000 sheets of A4 size plain paper with a cyan color alone while the sheet passing was stopped every time the image was output on 5 sheets.

Next, the electrophotographic photosensitive member was removed from the electrophotographic apparatus, and the thickness of its protective layer was measured, followed by the calculation of a difference between the thicknesses of the protective layer before and after the image output on 50,000 sheets, that is, the wear amount. The results of the evaluation are shown in Table 1.

effect resulting from the fact that the polymerizable compound contains a fluorine atom can be easily expressed, and the effect lasts in a continuous manner at the time of the endurance use of the electrophotographic photosensitive member.

Meanwhile, it has been revealed in the comparative example photosensitive members that when the compound represented by the general formula (1) is a polymerizable compound free of any fluorine atom, the effects of the present invention are not observed. Each of Comparative Compound No. 1 and Comparative Compound No. 2 had a poor alleviating effect on its affinity for the discharge product or moisture of the surface layer because the hole-transportable compound having a polymerizable functional group to be used together with any such compound was free of any fluorine atom, and hence both the deterioration of the electrical characteristics of the comparative example photosensitive members using the comparative compounds and the worsening of the image defects thereof were observed. Each of Comparative Compound No. 3 and Comparative

TABLE 1

| | | | Result of evaluation of photosensitive member | | | | |
|---|---|---|---|---|---|---|---|
| | Polymerizable compound No. | Addition amount ratio (%) | Image smearing evaluation [rank] | Image unevenness evaluation [rank] | Sensitivity [μJ/cm$^2$] | Residual potential [−V] | Wear amount [μm] |
| Example 1 | Exemplified Compound No. 1 | 30 | 4 | 5 | 0.28 | 26 | 0.5 |
| Example 2 | Exemplified Compound No. 8 | 30 | 3 | 4 | 0.28 | 25 | 0.6 |
| Example 3 | Exemplified Compound No. 9 | 30 | 5 | 5 | 0.28 | 28 | 0.5 |
| Example 4 | Exemplified Compound No. 13 | 30 | 5 | 5 | 0.28 | 28 | 0.6 |
| Example 5 | Exemplified Compound No. 14 | 30 | 4 | 5 | 0.30 | 32 | 0.6 |
| Example 6 | Exemplified Compound No. 29 | 30 | 5 | 5 | 0.29 | 28 | 0.6 |
| Example 7 | Exemplified Compound No. 35 | 30 | 5 | 5 | 0.29 | 29 | 0.7 |
| Example 8 | Exemplified Compound No. 46 | 20 | 3 | 4 | 0.27 | 24 | 0.4 |
| Example 9 | Exemplified Compound No. 46 | 30 | 4 | 5 | 0.28 | 27 | 0.4 |
| Example 10 | Exemplified Compound No. 46 | 40 | 5 | 5 | 0.29 | 32 | 0.4 |
| Example 11 | Exemplified Compound No. 1 | 30 | 4 | 5 | 0.28 | 27 | 0.6 |
| Example 12 | Exemplified Compound No. 46 | 30 | 5 | 5 | 0.28 | 27 | 0.4 |
| Example 13 | Exemplified Compound No. 1 | 30 | 4 | 4 | 0.30 | 42 | 0.8 |
| Example 14 | Exemplified Compound No. 46 | 30 | 5 | 4 | 0.30 | 45 | 0.6 |
| Example 15 | Exemplified Compound No. 12 | 30 | 4 | 4 | 0.29 | 30 | 0.6 |
| Example 16 | Exemplified Compound No. 32 | 30 | 5 | 5 | 0.28 | 29 | 0.6 |
| Example 17 | Exemplified Compound No. 63 | 20 | 4 | 4 | 0.29 | 33 | 0.6 |
| Example 18 | Exemplified Compound No. 70 | 20 | 4 | 4 | 0.29 | 34 | 0.5 |
| Comparative Example 1 | Comparative Compound No. 1 | 30 | 1 | 1 | 0.38 | 67 | 1.8 |
| Comparative Example 2 | Comparative Compound No. 2 | 30 | 1 | 1 | 0.34 | 69 | 1.3 |
| Comparative Example 3 | Comparative Compound No. 3 | 30 | 2 | 2 | 0.36 | 53 | 1.5 |
| Comparative Example 4 | Comparative Compound No. 4 | 30 | 2 | 2 | 0.36 | 51 | 1.7 |
| Comparative Example 5 | Comparative Compound No. 5 | 30 | 2 | 3 | 0.32 | 64 | 0.9 |

As can be seen from the results of Table 1, the electrophotographic photosensitive member of the present invention has satisfactory electrical characteristics and high durability, and suppresses the occurrence of image smearing and image density unevenness under a high-temperature and high-humidity environment to a larger extent than the comparative example photosensitive members do.

The inventors have assumed that when a benzene ring structure of the polymerizable compound of the present invention has a fluorine atom or a fluorine-containing substituent, the compound is satisfactorily compatible in the material composition of the surface layer, and is hence uniformly dispersed in the entirety of the surface layer. The inventors have assumed that because of the foregoing, an Compound No. 4 was free of any benzene ring structure, and hence had so poor compatibility with the hole-transportable compound having a polymerizable functional group, the hole-transportable compound forming the surface layer of each of the comparative example photosensitive members using the comparative compounds, as to cause phase separation. Probably because of the foregoing, the comparative compounds do not express proper effects. The comparative example photosensitive member 5 using Comparative Compound No. 5 does not sufficiently express the effects of the present invention. The inventors have considered that this is because the main skeleton structure of Comparative Compound No. 5 did not conform to the specifications of the present invention.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-158091, filed Aug. 18, 2017, which is hereby incorporated by reference herein in its entirety.

What is claimed is:

1. An electrophotographic photosensitive member, comprising:

an electroconductive support; and a photosensitive layer formed on the electroconductive support, wherein a surface layer of the electrophotographic photosensitive member contains a copolymer of a hole-transportable compound having a polymerizable functional group and a compound represented by formula (1)

$$Ar^1\text{-}(L^1\text{-}P^1)_m \quad (1)$$

where $L^1$ represents a divalent group represented by formula (3) or formula (4), $P^1$ represents a polymerizable functional group, m represents an integer of 1 to 4, with the proviso that when m represents 2 or more, $L^1$'s may be identical to or different from each other and $P^1$'s may be identical to or different from each other, and $Ar^1$ represents an m-valent group of which m hydrogen atom(s) is/are removed in a compound represented by formula (2)

$$R^1\text{—}R^2\text{—}R^3 \quad (2)$$

where $R^1$ and $R^3$ independently represent a phenyl group or a biphenylyl group, and $R^2$ represents a single bond, a phenylene group or a biphenylylene group, where the phenyl group, the biphenylyl group, the phenylene group and the biphenylylene group are optionally substituted with substituents selected from the group consisting of a fluorine atom, a fluorinated $C_{1-6}$ alkyl group, a fluorinated $C_{1-6}$ alkoxy group, a $C_{1-6}$ alkyl group, and a $C_{1-6}$ alkoxy group, with the proviso that at least one of $R^1$ to $R^3$ has at least one substituent selected from the group consisting of the fluorine atom, the fluorinated $C_{1-6}$ alkyl group, and the fluorinated $C_{1-6}$ alkoxy group, where the m hydrogen atom(s) to be removed is/are selected from hydrogen atoms bonded to carbon atoms constituting the phenyl group, hydrogen atoms bonded to carbon atoms constituting the biphenyl group, hydrogen atoms bonded to carbon atoms constituting the phenylene group, and hydrogen atoms bound to carbon atoms constituting the biphenylene group in the compound of formula (2);

$$(R^4)_n \quad (3)$$

$$(O\text{—}R^5)_q \quad (4)$$

where $R^4$ represents a $C_{1-6}$ alkylene group, and n represents 0 or 1;

where $R^5$ represents a $C_{1-6}$ alkylene group, and q represents an integer of 1 to 4.

2. An electrophotographic photosensitive member according to claim 1, wherein the compound represented by formula (1) comprises a compound represented by one of formula (5) and formula (6)

$$Ar^1\text{-}(R^4\text{—}P^1)_m \quad (5)$$

$$Ar^1\text{-}(O\text{—}R^5\text{—}P^1)_m \quad (6).$$

3. An electrophotographic photosensitive member according to claim 1, wherein m represents 2 or less.

4. An electrophotographic photosensitive member according to claim 1, wherein the hole-transportable compound having the polymerizable functional group comprises a hole-transporting substance having a triarylamine structure.

5. An electrophotographic photosensitive member according to claim 1, wherein a mass ratio of the compound represented by formula (1) with respect to a total mass of the hole-transportable compound having the polymerizable functional group and the compound represented by formula (1) is from 5 to 70% by mass.

6. An electrophotographic photosensitive member according to claim 5, wherein the mass ratio of the compound represented by formula (1) with respect to the total mass of the hole-transportable compound having the polymerizable functional group and the compound represented by formula (1) is from 10 to 50% by mass.

7. An electrophotographic photosensitive member according to claim 1, wherein $P^1$ and the polymerizable functional group of the hole-transportable compound each comprise a chain polymerizable functional group.

8. An electrophotographic photosensitive member according to claim 7, wherein the chain polymerizable functional group comprises one of an acryloyloxy group and a methacryloyloxy group.

9. A process cartridge, comprising:

an electrophotographic photosensitive member; and at least one member selected from the group consisting of a charging unit, a developing unit and a cleaning unit, said member and said electrophotographic photosensitive member being integrally supported by the process cartridge, and said process cartridge being removably mounted onto a main body of an electrophotographic apparatus, wherein the electrophotographic photosensitive member includes an electroconductive support and a photosensitive layer formed on the electroconductive support, a surface layer of the electrophotographic photosensitive member containing a copolymer of a hole-transportable compound having a polymerizable functional group and a compound represented by formula (1)

$$Ar^1\text{-}(L^1\text{-}P^1)_m \quad (1)$$

where $L^1$ represents a divalent group represented by formula (3) or formula (4), $P^1$ represents a polymerizable functional group, m represents an integer of 1 to 4, with the proviso that when m represents 2 or more, $L^1$'s may be identical to or different from each other and $P^1$'s may be identical to or different from each other, and $Ar^1$ represents an m-valent group of which m hydrogen atom(s) is/are removed in a compound represented by formula (2)

$$R^1\text{—}R^2\text{—}R^3 \quad (2)$$

where $R^1$ and $R^3$ independently represent a phenyl group or a biphenylyl group, and $R^2$ represents a single bond, a phenylene group or a biphenylylene group, where the phenyl group, the biphenylyl group, the phenylene group and the biphenylylene group are optionally substituted with substituents selected from the group consisting of a fluorine atom, a fluorinated $C_{1-6}$ alkyl group, a fluorinated $C_{1-6}$ alkoxy group, a $C_{1-6}$ alkyl group, and a $C_{1-6}$ alkoxy group, with the proviso that at least one of $R^1$ to $R^3$ has at least one substituent selected from the group consisting of the fluorine atom, the fluorinated $C_{1-6}$ alkyl group, and the fluorinated $C_{1-6}$ alkoxy group, where the m hydrogen atom(s) to be removed is/are selected from hydrogen atoms bonded to carbon atoms constituting the phenyl group, hydrogen atoms bonded to carbon atoms constituting the biphenyl group, hydrogen atoms bonded to carbon atoms constituting the phenylene group, and hydrogen atoms bound to carbon atoms constituting the biphenylene group in the compound of formula (2);

$$\text{-}(R^4)\text{-}_n \quad (3)$$

$$\text{-}(O\text{—}R^5)\text{-}_q \quad (4)$$

where $R^4$ represents a $C_{1-6}$ alkylene group, and n represents 0 or 1;

where $R^5$ represents a $C_{1-6}$ alkylene group, and q represents an integer of 1 to 4.

10. An electrophotographic apparatus, comprising:

an electrophotographic photosensitive member;

a charging unit;

an exposing unit;

a developing unit; and a transferring unit, wherein the electrophotographic photosensitive member includes an electroconductive support and a photosensitive layer formed on the electroconductive support, a surface layer of the electrophotographic photosensitive member containing a copolymer of a hole-transportable compound having a polymerizable functional group and a compound represented by formula (1)

$$Ar^1\text{-}(L^1\text{-}P^1)_m \quad (1)$$

where $L^1$ represents a divalent group represented by formula (3) or formula (4), $P^1$ represents a polymerizable functional group, m represents an integer of 1 to 4, with the proviso that when m represents 2 or more, $L^1$'s may be identical to or different from each other and $P^1$'s may be identical to or different from each other, and $Ar^1$ represents an m-valent group of which m hydrogen atom(s) is/are removed in a compound represented by formula (2)

$$R^1\text{—}R^2\text{—}R^3 \quad (2)$$

where $R^1$ and $R^3$ independently represent a phenyl group or a biphenylyl group, and $R^2$ represents a single bond, a phenylene group or a biphenylylene group, where the phenyl group, the biphenylyl group, the phenylene group and the biphenylylene group are optionally substituted with substituents selected from the group consisting of a fluorine atom, a fluorinated $C_{1-6}$ alkyl group, a fluorinated $C_{1-6}$ alkoxy group, a $C_{1-6}$ alkyl group, and a $C_{1-6}$ alkoxy group, with the proviso that at least one of $R^1$ to $R^3$ has at least one substituent selected from the group consisting of the fluorine atom, the fluorinated $C_{1-6}$ alkyl group, and the fluorinated $C_{1-6}$ alkoxy group, where the m hydrogen atom(s) to be removed is/are selected from hydrogen atoms bonded to carbon atoms constituting the phenyl group, hydrogen atoms bonded to carbon atoms constituting the biphenyl group, hydrogen atoms bonded to carbon atoms constituting the phenylene group, and hydrogen atoms bound to carbon atoms constituting the biphenylene group in the compound of formula (2);

$$\text{-}(R^4)\text{-}_n \quad (3)$$

$$\text{-}(O\text{—}R^5)\text{-}_q \quad (4)$$

where $R^4$ represents a $C_{1-6}$ alkylene group, and n represents 0 or 1;

where $R^5$ represents a $C_{1-6}$ alkylene group, and q represents an integer of 1 to 4.

11. A method of producing an electrophotographic photosensitive member including an electroconductive support and a photosensitive layer formed on the electroconductive support, the method comprising the steps of:

copolymerizing a film obtained by applying an application liquid produced by mixing a hole-transportable compound having a polymerizable functional group and a compound represented by formula (1) to produce the electrophotographic photosensitive member $$Ar^1\text{-}(L^1\text{-}P^1)_m \quad (1)$$

where $L^1$ represents a divalent group represented by formula (3) or formula (4), $P^1$ represents a polymerizable functional group, m represents an integer of 1 to 4, with the proviso that when m represents 2 or more, $L^1$'s may be identical to or different from each other and $P^1$'s may be identical to or different from each other, and $Ar^1$ represents an m-valent group of which m hydrogen atom(s) is/are removed in a compound represented by formula (2)

$$R^1\text{—}R^2\text{—}R^3 \quad (2)$$

where $R^1$ and $R^3$ independently represent a phenyl group or a biphenylyl group, and $R^2$ represents a single bond, a phenylene group or a biphenylylene group, where the phenyl group, the biphenylyl group, the phenylene group and the biphenylylene group are optionally substituted with substituents selected from the group consisting of a fluorine atom, a fluorinated $C_{1-6}$ alkyl group, a fluorinated $C_{1-6}$ alkoxy group, a $C_{1-6}$ alkyl group, and a $C_{1-6}$ alkoxy group, with the proviso that at least one of $R^1$ to $R^3$ has at least one substituent selected from the group consisting of the fluorine atom, the fluorinated $C_{1-6}$ alkyl group, and the fluorinated $C_{1-6}$ alkoxy group, where the m hydrogen atom(s) to be removed is/are selected from hydrogen atoms bonded to carbon atoms constituting the phenyl group, hydrogen atoms bonded to carbon atoms constituting the biphenyl group, hydrogen atoms bonded to carbon atoms constituting the phenylene group, and hydrogen atoms bound to carbon atoms constituting the biphenylene group in the compound of formula (2);

$$\text{-}(R^4)\text{-}_n \quad (3)$$

$$\text{-}(O\text{—}R^5)\text{-}_q \quad (4)$$

where $R^4$ represents a $C_{1-6}$ alkylene group, and n represents 0 or 1;

where $R^5$ represents a $C_{1-6}$ alkylene group, and q represents an integer of 1 to 4.

* * * * *